US011123259B2

(12) United States Patent
Baetica et al.

(10) Patent No.: US 11,123,259 B2
(45) Date of Patent: Sep. 21, 2021

(54) COMBINATION INTERNAL AND EXTERNAL SEXUAL STIMULATION DEVICE

(71) Applicant: WOW TECH CANADA LTD., Ottawa (CA)

(72) Inventors: Florin Baetica, Brockville (CA); Bruce Donald Murison, North Gower (CA)

(73) Assignee: WOW TECH CANADA LTD., Ottawa (CA)

( * ) Notice: Subject to any disclaimer, the term of this patent is extended or adjusted under 35 U.S.C. 154(b) by 245 days.

(21) Appl. No.: 15/742,649

(22) PCT Filed: Jul. 8, 2016

(86) PCT No.: PCT/CA2016/050800
§ 371 (c)(1),
(2) Date: Jan. 8, 2018

(87) PCT Pub. No.: WO2017/004721
PCT Pub. Date: Jan. 12, 2017

(65) Prior Publication Data

US 2018/0185237 A1 Jul. 5, 2018

Related U.S. Application Data

(60) Provisional application No. 62/189,989, filed on Jul. 8, 2015.

(51) Int. Cl.
*A61H 19/00* (2006.01)
*A61H 21/00* (2006.01)
*G08C 17/02* (2006.01)
*A61H 23/02* (2006.01)

(52) U.S. Cl.
CPC ..... *A61H 19/44* (2013.01); *A61H 19/30* (2013.01); *A61H 19/32* (2013.01); *A61H 19/34* (2013.01);
(Continued)

(58) Field of Classification Search
CPC ..... A61H 19/00–50; A61H 21/00
See application file for complete search history.

(56) References Cited

U.S. PATENT DOCUMENTS

2007/0142754 A1 6/2007 Nan
2008/0009775 A1 1/2008 Munson
(Continued)

FOREIGN PATENT DOCUMENTS

CA 2774254 A1 10/2013
CN 104367458 A 2/2015
(Continued)

OTHER PUBLICATIONS

International Search Report with Written Opinion dated Sep. 14, 2016 of corresponding PCT/CA2016/050800; 10 pgs.
(Continued)

*Primary Examiner* — Thaddeus B Cox
(74) *Attorney, Agent, or Firm* — Maier & Maier, PLLC

(57) ABSTRACT

A sexual stimulation device comprising: (a) an elongate member comprising a proximal end, and a distal end dimensioned for placement in an orifice of a user; (b) an external stimulation arm comprising a proximal end, a distal end, and an external stimulation surface; and (c) a flexible connecting portion that connects the elongate member to the external stimulation arm at their respective proximal ends; wherein the flexible connecting portion permits movement of the external stimulation arm relative to the elongate member between an open position and a compressed position.

31 Claims, 26 Drawing Sheets

(52) U.S. Cl.
CPC ..... *A61H 21/00* (2013.01); *A61H 23/0254* (2013.01); *A61H 23/0263* (2013.01); *G08C 17/02* (2013.01); *A61H 2201/1654* (2013.01); *A61H 2201/5002* (2013.01); *A61H 2201/5005* (2013.01); *A61H 2201/5007* (2013.01); *A61H 2201/5012* (2013.01); *A61H 2201/5028* (2013.01); *A61H 2201/5038* (2013.01); *A61H 2201/5058* (2013.01); *A61H 2201/5064* (2013.01); *A61H 2201/5066* (2013.01); *A61H 2201/5071* (2013.01); *A61H 2201/5082* (2013.01); *A61H 2201/5084* (2013.01); *A61H 2201/5089* (2013.01); *A61H 2201/5092* (2013.01); *A61H 2201/5097* (2013.01); *A61H 2230/04* (2013.01); *A61H 2230/25* (2013.01); *G08C 2201/93* (2013.01)

(56) References Cited

U.S. PATENT DOCUMENTS

| | | | | |
|---|---|---|---|---|
| 2012/0330201 | A1 | 12/2012 | Turner et al. | |
| 2013/0289346 | A1 | 10/2013 | Standfest | |
| 2014/0228628 | A1 | 8/2014 | De Alva | |
| 2014/0357944 | A1* | 12/2014 | Spietz | A61H 19/40 600/38 |
| 2016/0000642 | A1* | 1/2016 | Zipper | A61H 23/0263 600/38 |
| 2016/0120737 | A1 | 5/2016 | Sedic | |
| 2016/0331629 | A1* | 11/2016 | Pearson | A61H 19/44 |

FOREIGN PATENT DOCUMENTS

| | | | | |
|---|---|---|---|---|
| EP | 1743616 | A1 | 1/2007 | |
| WO | WO-2013003954 | A1 * | 1/2013 | A61H 23/00 |
| WO | 2014/008606 | A1 | 1/2014 | |
| WO | 2014/131110 | A1 | 9/2014 | |
| WO | 2017/004721 | A1 | 1/2017 | |

OTHER PUBLICATIONS

International Preliminary Report on Patentability dated Dec. 28, 2016 of corresponding PCT/CA2016/050800; 3 pgs.
Australian Office Action dated Dec. 7, 2020, in connection with corresponding AU Application No. 2016289103; 5 pages.

* cited by examiner

COMBINATION INTERNAL AND EXTERNAL SEXUAL STIMULATION DEVICE

CROSS REFERENCE TO RELATED APPLICATIONS

This application is a 371 application of International application No. PCT/CA2016/050800 filed on Jul. 8, 2016, which claims priority to and the benefit of U.S. provisional application No. 62/189,989 filed on Jul. 8, 2015, the entire contents of which are incorporated herein by reference.

FIELD OF THE INVENTION

The present application pertains to the field of sexual stimulation devices.

BACKGROUND

Sexual stimulation devices for inducing sexual pleasure via self-stimulation of the user are well known and have been commercially available for many decades.

Standard vibrators including a phallus-like shaft, as well as G-spot stimulation devices, have long been known and employed by women to provide self-stimulation. Traditional G-spot stimulation devices are generally shaped like a standard vibrator in that they include a phallus-like shaft, but they differ from standard vibrators in that they also include a curved or flared end that is used to stimulate the G-spot.

Despite the ongoing debate as to the existence and distinct structure of the G-spot (or the Gräfenberg spot), G-spot stimulation devices continue to make up a significant segment of the sexual stimulation device market. Such devices are designed to massage the G-spot, a region in the anterior vagina that many women report to be an erogenous zone that is hypersensitive to sexual stimulation. The location of the G-spot is typically described as being located in the anterior wall of the vagina, about one to three inches from the vaginal opening. As a result, G-spot stimulation devices include a region for direct stimulation of the G-spot.

Combination vibrators have been designed to simultaneously stimulate both the vagina (in particular, the G-spot) and the clitoris or clitoral area. The well-known rabbit vibrator is an example of a combination vibrator. Rabbit vibrators typically include a shaft portion terminating in a G-spot stimulation hook or flare, as well as a clitoral stimulating device located near the base of the shaft portion. The device gets its name from the shape of the clitoral stimulating device, which usually resembles an animal, such as a rabbit, a dolphin, a butterfly, etc. Other rabbit-type vibrators may have a simple finger or thumb attachment as the clitoral stimulating device.

WO 2014/008606 describes a combination G-spot and clitoral stimulation device.

A need remains for an alternative combination internal and external sexual stimulation device.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a sexual stimulation device, specifically a combination internal and external sexual stimulation device.

In accordance with an aspect of the present application, there is provided a sexual stimulation device comprising: (a) an elongate member comprising a proximal end and a distal end, wherein the distal end is dimensioned for placement in an orifice of a user; (b) an external stimulation arm comprising a proximal external stimulation arm end, a distal external stimulation arm end, and an external stimulation surface for stimulating an external surface of the user when the distal end of the elongate member is placed in the orifice; and (c) a flexible connecting portion that connects the elongate member to the external stimulation arm at their respective proximal ends; wherein the flexible connecting portion permits movement of the external stimulation arm relative to the elongate member between: an open position, wherein the distal external stimulation arm end is spaced apart from the proximal end of the elongate member; and a compressed position, wherein the distal external stimulation arm end is in close proximity to the proximal end of the elongate member; and wherein the external stimulation arm comprises an inner face facing the proximal end of the elongate member in the open position, and an outer face opposite from the inner face, and the external stimulation surface extends along at least a portion of the outer face of the external stimulation arm.

In accordance with another aspect of the present application, there is provided a sexual stimulation device comprising: (a) an elongate member comprising a proximal end and a distal end, wherein the distal end is dimensioned for placement in an orifice of a user; (b) an external stimulation arm comprising a proximal external stimulation arm end, a distal external stimulation arm end, and an external stimulation surface for stimulating an external surface of the user when the distal end of the elongate member is placed in the orifice; and (c) a flexible connecting portion that connects the elongate member to the external stimulation arm at their respective proximal ends; wherein the flexible connecting portion permits movement of the external stimulation arm relative to the elongate member between: an open position, wherein the flexible connecting portion together with the external stimulation arm and the elongate member define a gap therebetween; and a compressed position, wherein the gap is decreased; and wherein the external stimulation arm comprises an inner face bordering the gap and an outer face opposite from the inner face, and the external stimulation surface extends along at least a portion of the outer face of the external stimulation arm.

In accordance with another aspect of the present application, there is provided a sexual stimulation device comprising: (a) an elongate member comprising a proximal end and a distal end, wherein the distal end is dimensioned for placement in a vagina, preferably for internal G-spot stimulation; (b) a clitoral stimulation arm comprising a proximal clitoral stimulation arm end, a distal clitoral stimulation arm end, and a clitoral stimulation surface; and (c) a flexible connecting portion that connects the elongate member to the clitoral stimulation arm at their respective proximal ends; wherein the flexible connecting portion permits movement of the clitoral stimulation arm relative to the elongate member between: an open position, wherein the distal clitoral stimulation arm end is spaced apart from the proximal end of the elongate member; and a compressed position, wherein the distal clitoral stimulation arm end is in close proximity to the proximal end of the elongate member; and wherein the clitoral stimulation arm comprises an inner face facing the proximal end of the elongate member in the open position, and an outer face opposite from the inner face, and the clitoral stimulation surface extends along at least a portion of the outer face of the clitoral stimulation arm.

In yet another aspect, there is provided a sexual stimulation device comprising: (a) an elongate member comprising a proximal end and a distal end, wherein the distal end is dimensioned for placement in a vagina, preferably for internal G-spot stimulation; (b) a clitoral stimulation arm comprising a proximal clitoral stimulation arm end, a distal clitoral stimulation arm end, and a clitoral stimulation surface; and (c) a flexible connecting portion that connects the elongate member to the clitoral stimulation arm at their respective proximal ends; wherein the flexible connecting portion permits movement of the clitoral stimulation arm relative to the elongate member between: an open position, wherein the flexible connecting portion together with the clitoral stimulation arm and the elongate member define a gap therebetween; and a compressed position, wherein the gap is decreased; and wherein the clitoral stimulation arm comprises an inner face bordering the gap and an outer face opposite from the inner face, and the clitoral stimulation surface extends along at least a portion of the outer face of the clitoral stimulation arm.

BRIEF DESCRIPTION OF THE DRAWINGS

FIG. 8(*a*) depicts the stimulation device in an open position; FIG. 8(*b*) depicts the stimulation device in a partially compressed position; and FIG. 8(*c*) depicts the device in a compressed position;

FIG. 9(*a*) depicts the stimulation device in an open position; FIG. 9(*b*) depicts the stimulation device in a partially compressed position; and FIG. 9(*c*) depicts the device in a compressed position;

FIG. 10(*a*) depicts the stimulation device in an open position; FIG. 10(*b*) depicts the stimulation device in a partially compressed position; and FIG. 10(*c*) depicts the device in a compressed position;

FIG. 12(*a*) depicts the stimulation device in an open position; FIG. 12(*b*) depicts the stimulation device in a partially compressed position; and FIG. 12(*c*) depicts the device in a compressed position;

DETAILED DESCRIPTION OF THE INVENTION

Definitions

Figure 1:
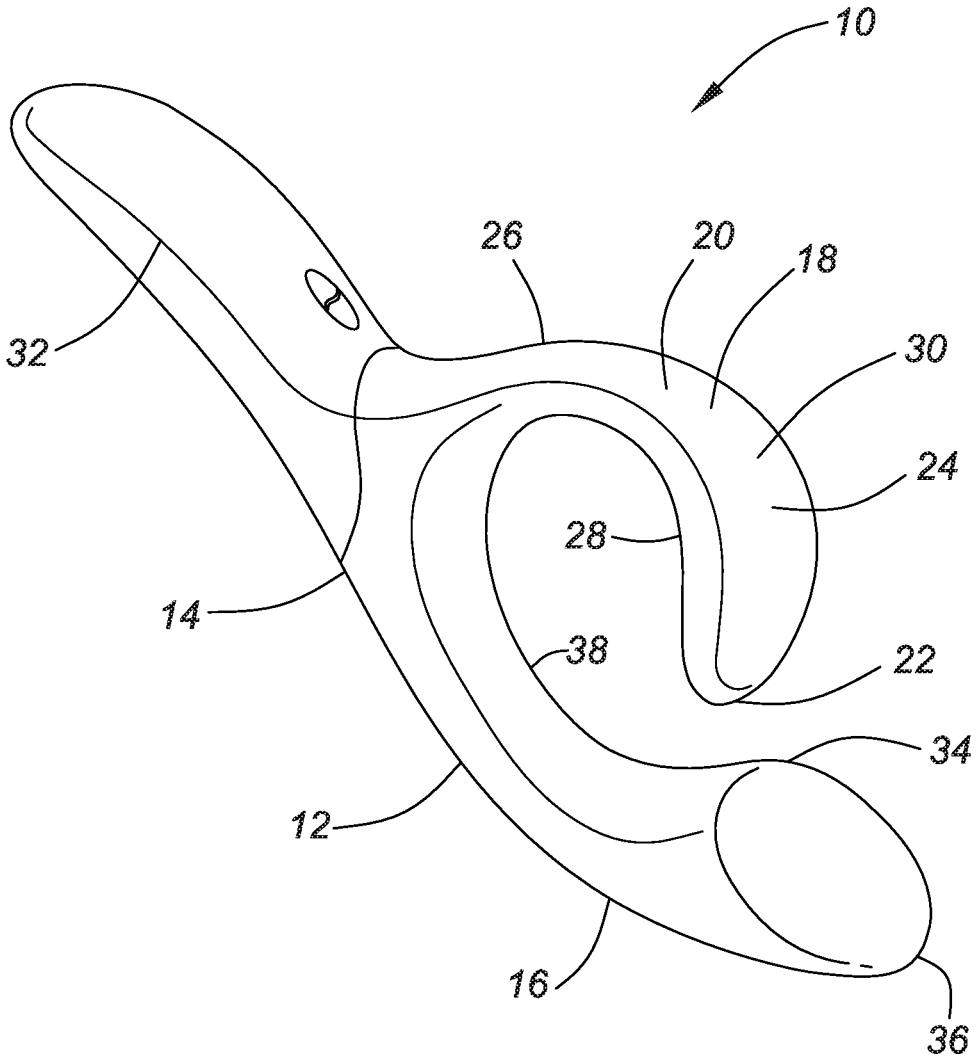
FIG. 1 is a perspective view of a combination internal and external sexual stimulation device, according to one embodiment of the present application, in an open position.

Unless defined otherwise, all technical and scientific terms used herein have the same meaning as commonly understood by one of ordinary skill in the art to which this invention belongs.

As used in the specification and claims, the singular forms "a", "an" and "the" include plural references unless the context clearly dictates otherwise.

The term "comprising" as used herein will be understood to mean that the list following is non-exhaustive and may or may not include any other additional suitable items, for example one or more further feature(s), component(s) and/or ingredient(s) as appropriate.

Terms of degree such as "substantially", "about" and "approximately" as used herein mean a reasonable amount of deviation of the modified term such that the end result is not significantly changed. These terms of degree should be construed as including a deviation of at least ±5% of the modified term if this deviation would not negate the meaning of the word it modifies.

The term "woman", as used herein, refers to a female human. That is, a woman is a human having a vagina. The terms "woman" and "female" are used interchangeably herein.

The term "perineum region", as used herein, refers to a region of the body located between the anus and scrotum of a man, or between the anus and vagina of a woman.

The term "flexible", as used herein, refers to the ability of a body that is capable of being bent or flexed. Something that is flexible can be, for example, resilient or malleable. The term "resilient," as used herein, refers to the ability of a body that has been subjected to an external force to recover, or substantially recover, its original size and/or shape, following deformation. The term "malleable," as used herein, refers to the ability of a body that has been subjected to an external force to deform and maintain, or substantially maintain, the deformed size and/or shape.

The term "spring-type hinge," as used herein, refers to a hinge formed by a piece of plastic having a thickness such that it bends over at least a portion of the length of the plastic upon application of a force. A spring-type hinge will be understood to operate in a similar manner as a leaf spring. A spring-type hinge typically can have a thickness of from about 1.00 mm to about 2.00 mm, or from about 1.25 mm to about 1.75 mm, although other thicknesses are possible depending on the nature of the material and the amount of spring force desired.

The term "living hinge," as used herein, refers to a hinge formed by a very thin piece of plastic that bends at a particular point and has little to no spring force. The plastic suffers very little stress when bent, thus living hinges have excellent durability. Living hinges typically can have a thickness of from about 0.1 to about 0.5 mm, typically approximately 0.2 mm, although other thicknesses are possible depending on the nature of the material and the amount of spring force desired.

The stimulation device described herein is a combination device designed for internal and external sexual stimulation, comprising an elongate member and an external stimulation arm interconnected by a flexible connecting portion. The embodiments as herein described are particularly suitable for simultaneous stimulation of a woman's vagina (in particular, the G-spot) and clitoris or clitoral area. However, those of skill in the art will appreciate that such a device can alternatively be used for simultaneous stimulation of a user's anus and perineum region, wherein the user can be male or female.

The stimulation device includes an elongate member comprising a proximal end and a distal end, wherein the distal end is dimensioned for placement in an orifice of a user, for internal stimulation. In one embodiment, the orifice is a vagina. In another embodiment, the distal end is dimensioned for placement in a vagina and preferably designed for internal G-spot stimulation to contact a portion of the anterior wall of the vagina, at or near the G-spot. For example, the distal end can include a G-spot stimulation region having various shapes, such as an inwardly curved hook or bend or a bulbous head. In one embodiment, the elongate member is phallus-shaped. In another embodiment, the orifice is an anus.

The device further includes an external stimulation arm comprising a proximal external stimulation arm end, a distal external stimulation arm end, and an external stimulation surface for stimulating an external surface of a user when the distal end of the elongate member is placed in the orifice.

In one embodiment, the external surface is a clitoris or clitoral area, and the external stimulation surface of the device is a clitoral stimulation surface or pad that is sized and positioned to contact the clitoral area during stimulation of the vagina by insertion and movement of the distal end of the elongate member in the vagina.

In another embodiment, the external surface is a perineum region of a user and the external stimulation surface of the device contacts the perineum region of a user during stimulation of the anus by insertion and movement of the distal end of the elongate member in the anus.

The elongate member and the external stimulation arm are connected at their respective proximal ends by a flexible connecting portion.

The flexible connecting portion permits movement of the external stimulation arm relative to the elongate member between an open position, wherein the distal external stimulation arm end is spaced apart from the proximal end of the elongate member, and a compressed position, wherein the distal external stimulation arm end is in close proximity to the proximal end of the elongate member. When the device is in the open position, the flexible connecting portion together with the external stimulation arm and the elongate member define a gap therebetween. When the device is in the compressed position, the gap is decreased. The flexible connecting portion together with the proximal external stimulation arm end and the proximal end of the elongate member can define a general U-shape or C-shape in the open position.

In one aspect, the external stimulation arm comprises an inner face which faces the proximal end of the elongate member when the device is in the open position, and an outer face opposite from the inner face. In another aspect, the external stimulation arm comprises an inner face which borders the above-noted gap, and an outer face opposite from the inner face. The external stimulation surface extends along at least a portion of the outer face of the external stimulation arm.

When a force is applied to the external stimulation surface of the external stimulation arm, such as by engagement of the external stimulation surface of the external stimulation arm with a clitoris or clitoral area of a user when the distal end of the elongate member is inserted into a vagina, this effects movement of the external stimulation arm relative to the elongate member towards the compressed position. When the force applied to the external stimulation surface of the external stimulation arm is decreased or removed, the device returns to the open position. In the absence of an applied force, the device remains in the open (resting) position. The flexible connecting portion can be either resilient or malleable, and preferably at least a portion of the connecting portion is resilient such that the connecting portion is resiliently flexible. The flexible connecting portion can maintain the distal external stimulation arm end resiliently spaced apart from the proximal end of the elongate member in the open position and/or resiliently urge the distal external stimulation arm end away from the proximal end of the elongate member when the external stimulation arm is moved toward the compressed position.

The stimulation device can further include a handle disposed on the proximal end of the elongate member, which allows the user to hold the device in place and manually move the distal end of the elongate member in and out of, and within, the orifice. Alternatively, the device can include a finger push spot for effecting movement of the elongate member into and/or within the orifice.

It will be appreciated that the design of the present device provides the user with the ability to maintain substantially constant contact between the external surface of the user that is to be stimulated and the external stimulation surface of the external stimulation arm even as the distal end of the elongate member is moved within the orifice, such as in a thrusting motion.

In accordance with an embodiment of the present application, there is provided a sexual stimulation device comprising: (a) an elongate member comprising a proximal end and a distal end, wherein the distal end is dimensioned for placement in an orifice of a user; (b) an external stimulation arm comprising a proximal external stimulation arm end, a distal external stimulation arm end, and an external stimulation surface for stimulating an external surface of the user when the distal end of the elongate member is placed in the orifice; and (c) a flexible connecting portion that connects the elongate member to the external stimulation arm at their respective proximal ends; wherein the flexible connecting portion permits movement of the external stimulation arm relative to the elongate member between: an open position, wherein the distal external stimulation arm end is spaced apart from the proximal end of the elongate member; and a compressed position, wherein the distal external stimulation arm end is in close proximity to the proximal end of the elongate member; and wherein the external stimulation arm comprises an inner face facing the proximal end of the elongate member in the open position, and an outer face opposite from the inner face, and the external stimulation surface extends along at least a portion of the outer face of the external stimulation arm. In one embodiment, when the device is in the open position, the flexible connecting portion together with the external stimulation arm and the elongate member define a gap therebetween and when the device is in the compressed position, the gap is decreased.

In accordance with another embodiment of the present application, there is provided a sexual stimulation device comprising: (a) an elongate member comprising a proximal end and a distal end, wherein the distal end is dimensioned for placement in an orifice of a user; (b) an external stimulation arm comprising a proximal external stimulation arm end, a distal external stimulation arm end, and an external stimulation surface for stimulating an external surface of the user when the distal end of the elongate member is placed in the orifice; and (c) a flexible connecting portion that connects the elongate member to the external stimulation arm at their respective proximal ends; wherein the flexible connecting portion permits movement of the external stimulation arm relative to the elongate member between: an open position, wherein the flexible connecting portion together with the external stimulation arm and the elongate member define a gap therebetween; and a compressed position, wherein the gap is decreased; and wherein the external stimulation arm comprises an inner face bordering the gap and an outer face opposite from the inner face, and the external stimulation surface extends along at least a portion of the outer face of the external stimulation arm.

In another embodiment, when the device is in the open position, the flexible connecting portion together with the proximal external stimulation arm end and the proximal end of the elongate member defines a general U-shape or C-shape. In yet another embodiment, the flexible connecting portion maintains the distal external stimulation arm end resiliently spaced apart from the proximal end of the elongate member in the open position and/or the flexible connecting portion resiliently urges the distal external stimulation arm end away from the proximal end of the elongate member when the external stimulation arm is moved toward the compressed position. In yet another embodiment, the device further comprises an internal skeleton which can be formed from molded plastic, a thermoplastic polymer, a resilient plastic, and/or pre-shaped metal. In another embodiment, the internal skeleton can be formed from a shape memory alloy, a thermoplastic polymer, or combinations thereof. In another embodiment, the internal skeleton can be formed from resilient materials, malleable materials, and combinations thereof. In yet another embodiment, the internal skeleton extends at least from the external stimulation arm, through the flexible connecting portion, to the elongate member. In yet another embodiment, the device comprises at least one stimulation source (such as a vibrational motor), which can be disposed in the external stimulation arm, the flexible connecting portion, the elongate member, or a combination thereof.

In accordance with another embodiment of the present application, there is provided a sexual stimulation device comprising: (a) an elongate member comprising a proximal end and a distal end, wherein the distal end is dimensioned for placement in a vagina, preferably for internal G-spot stimulation; (b) a clitoral stimulation arm comprising a proximal clitoral stimulation arm end, a distal clitoral stimulation arm end, and a clitoral stimulation surface; and (c) a flexible connecting portion that connects the elongate member to the clitoral stimulation arm at their respective proximal ends; wherein the flexible connecting portion permits movement of the clitoral stimulation arm relative to the elongate member between: an open position, wherein the distal clitoral stimulation arm end is spaced apart from the proximal end of the elongate member; and a compressed position, wherein the distal clitoral stimulation arm end is in close proximity to the proximal end of the elongate member; and wherein the clitoral stimulation arm comprises an inner face facing the proximal end of the elongate member in the open position, and an outer face opposite from the inner face, and the clitoral stimulation surface extends along at least a portion of the outer face of the clitoral stimulation arm. In another embodiment, when the device is in the open position, the flexible connecting portion together with the clitoral stimulation arm and the elongate member define a gap therebetween and when the device is in the compressed position, the gap is decreased.

In yet another embodiment, there is provided a sexual stimulation device comprising: (a) an elongate member comprising a proximal end and a distal end, wherein the distal end is dimensioned for placement in a vagina, preferably for internal G-spot stimulation; (b) a clitoral stimulation arm comprising a proximal clitoral stimulation arm end, a distal clitoral stimulation arm end, and a clitoral stimulation surface; and (c) a flexible connecting portion that connects the elongate member to the clitoral stimulation arm at their respective proximal ends; wherein the flexible connecting portion permits movement of the clitoral stimulation arm relative to the elongate member between: an open position, wherein the flexible connecting portion together with the clitoral stimulation arm and the elongate member define a gap therebetween; and a compressed position, wherein the gap is decreased; and wherein the clitoral stimulation arm comprises an inner face bordering the gap and an outer face opposite from the inner face, and the clitoral stimulation surface extends along at least a portion of the outer face of the clitoral stimulation arm.

In yet another embodiment, when the device is in the open position, the flexible connecting portion together with the proximal clitoral stimulation arm end and the proximal end of the elongate member defines a general U-shape or C-shape. In still another embodiment, the flexible connecting portion maintains the distal clitoral stimulation arm end resiliently spaced apart from the proximal end of the elongate member in the open position and/or the flexible connecting portion resiliently urges the distal clitoral stimulation arm end away from the proximal end of the elongate member when the clitoral stimulation arm is moved toward the compressed position. In yet another embodiment, the device further comprises an internal skeleton which can be formed from molded plastic, a thermoplastic polymer, a resilient plastic, and/or pre-shaped metal. In another embodiment, the internal skeleton can be formed from a shape memory alloy, a thermoplastic polymer, or combinations thereof. In another embodiment, the internal skeleton can be formed from resilient materials, malleable materials, and combinations thereof. In yet another embodiment, the internal skeleton extends at least from the clitoral stimulation arm, through the flexible connecting portion, to the elongate member. In yet another embodiment, the device comprises at least one stimulation source (such as a vibrational motor), which can be disposed in the clitoral stimulation arm, the flexible connecting portion, the elongate member, or a combination thereof.

In one embodiment, the present device provides the user with the ability to maintain substantially constant contact between the clitoral area of a user and the clitoral stimulation surface or pad of the clitoral stimulation arm even as the distal end of the elongate member is moved within the vagina of the user, such as in a thrusting motion. In another embodiment, the present device provides the user with the ability to maintain substantially constant contact between the perineum region of a user and the external stimulation surface or pad of the external stimulation arm even as the distal end of the elongate member is moved within the anus of the user, such as in a thrusting motion.

In still another embodiment, the device further comprises a handle, which optionally extends outwardly from the proximal end of the elongate member such that the handle and the elongate member form a generally sigmoidal shape in side view.

In another embodiment, the flexible connecting portion is resilient, malleable, or a combination thereof. In another embodiment, at least a portion of the flexible connecting portion is resilient.

In another embodiment, the device comprises an outer layer of non-toxic material. In yet another embodiment, the non-toxic material is silicone.

In another embodiment, the device comprises a power source, which can be at least one battery, such as a rechargeable battery. In another embodiment, the device further comprises a switch mechanism to turn the at least one stimulation source (such as a vibrational source, source of movement, or electrostimulation source) on and off. In yet another embodiment, the switch mechanism has a plurality of settings to control the type and strength of vibration of the least one vibrational source and/or the type and strength of movement of the at least one source of movement during use of the device. In another embodiment, the at least one vibrational source and/or source of movement is a plurality of motors, and the plurality of settings can power any combination of the motors at the same or different levels or direction of rotation or other movement. In yet another embodiment, the switch mechanism is located on the handle of the device.

In still yet another embodiment, the internal skeleton extends at least partially into the handle of the device. In yet another embodiment, the housing is substantially vibrationally isolated from the internal skeleton by a layer of a compressively resistive material disposed between the housing and the internal skeleton, wherein the compressively resistive material is optionally selected from silicone, rubber, elastomer, or latex.

In yet another embodiment, the internal skeleton comprises a first arm and a second arm disposed within the flexible connecting portion, wherein: the first arm is hingedly connected to a first portion of the internal skeleton located at or near the proximal end of the elongate member, at a first hinge point, forming a first hinge; the first arm is hingedly connected to a second portion of the internal skeleton located at or near the proximal external stimulation arm end of the external stimulation arm, at a second hinge point, forming a second hinge; the second arm is hingedly connected to a third portion of the internal skeleton located at or near the proximal end of the elongate member, at a third hinge point, forming a third hinge; and the second arm is hingedly connected to a fourth portion of the internal skeleton located at or near the proximal external stimulation arm end of the external stimulation arm at a fourth hinge point, forming a fourth hinge; wherein, in side view, the first, second, third, and fourth hinge points together define a quadrangular shape, preferably a generally trapezoidal or generally parallelogram shape. In yet another embodiment, each of the first, second, third, and fourth hinges are independently selected from a living hinge, a spring-type hinge, a pivot, or a combination thereof.

In still yet another embodiment, the internal skeleton further comprises at least one spring coupled to the first arm and/or the second arm to maintain the device in the open position, wherein the spring is selected from a compression or tension spring, a silicone spring, a torsion spring, or a leaf spring.

In another embodiment, the internal skeleton comprises a single arm disposed within the flexible connecting portion, wherein the single arm is tapered towards a middle section of the flexible connecting portion.

The present stimulation device having now been generally described, the following description provides details of specific, non-limiting embodiments of the device.

Figure 6:
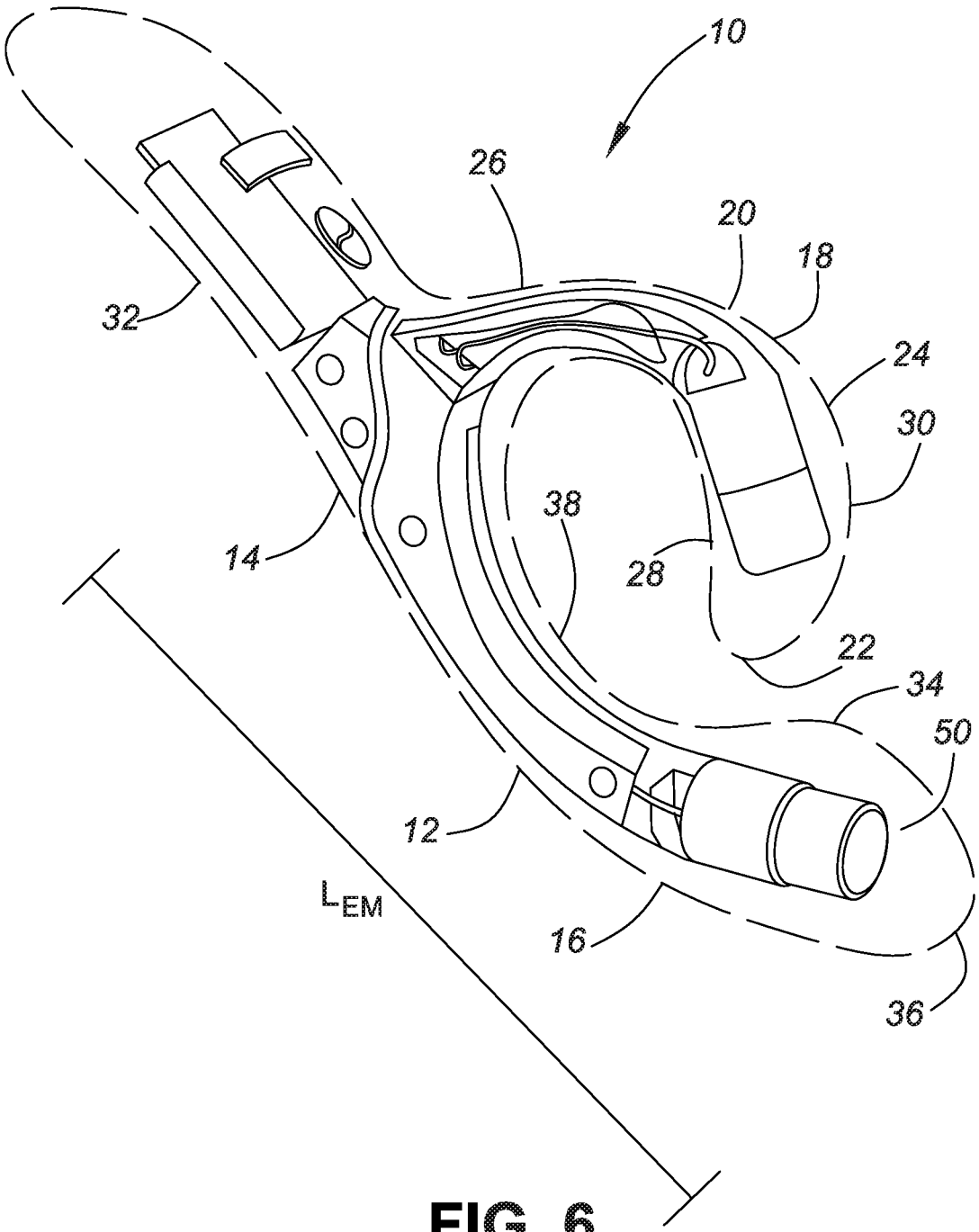
FIG. 6 is a simplified perspective view of the stimulation device shown in FIG. 1, in an open position, with a transparent outer layer and handle housing, and semi-transparent internal skeleton, so that certain components of the internal structure are visible.
Figure 7:
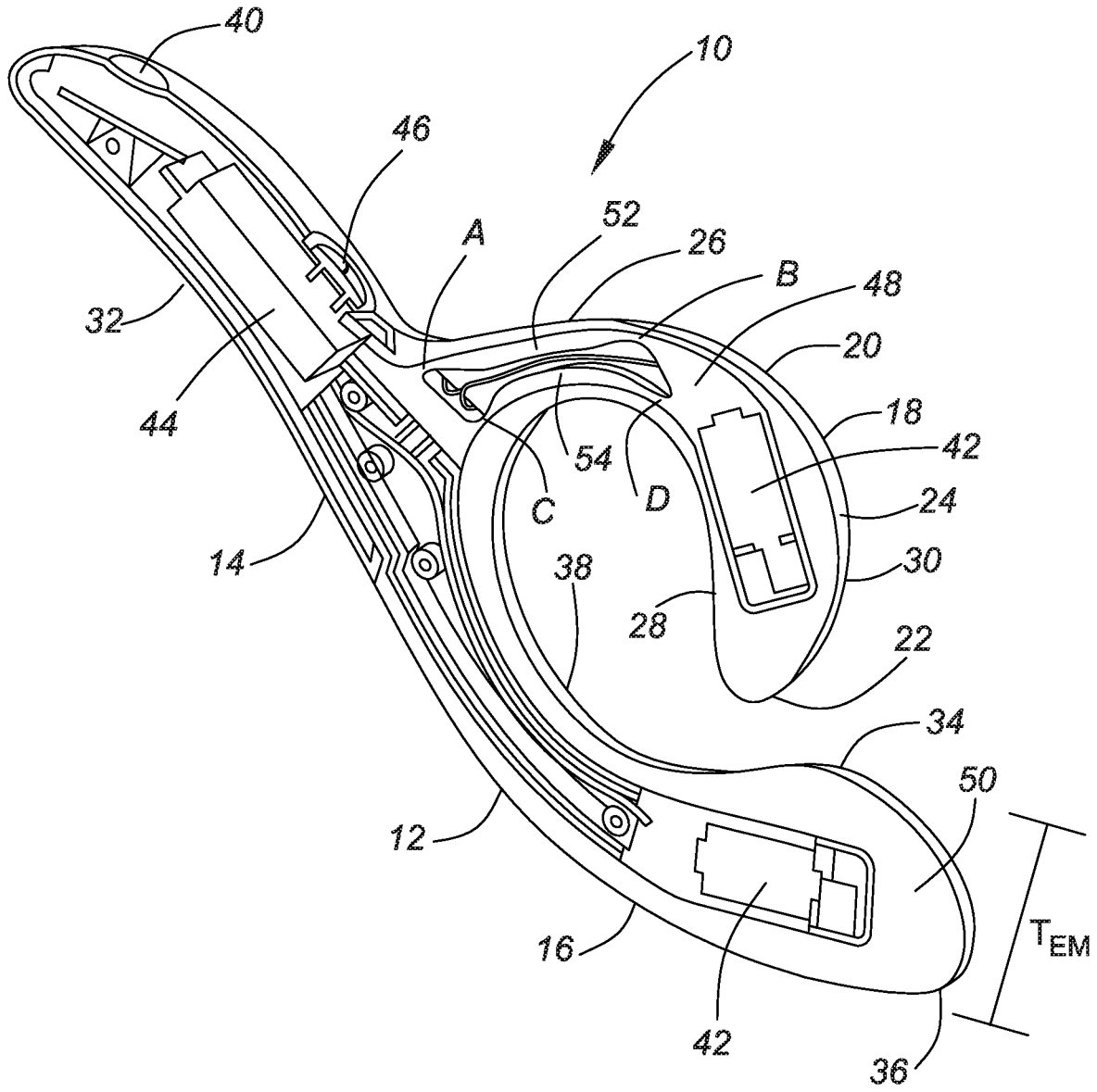
FIG. 7 is a simplified longitudinal cross-sectional view of the stimulation device shown in FIG. 1, in an open position.
Figure 8A:
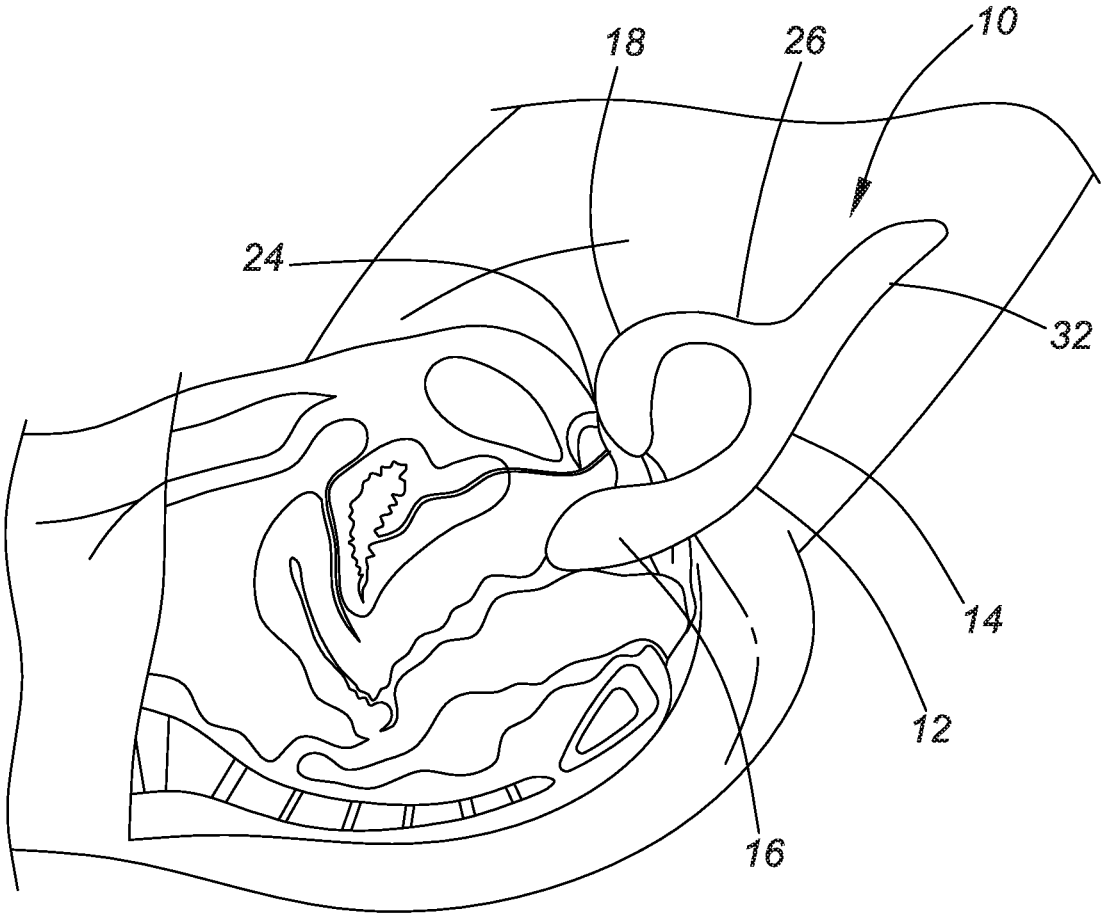
FIGS. 8(*a*)-(*c*) depict a simplified side view of the stimulation device shown in FIG. 1 engaged with a female user, wherein the distal end of the elongate member is inserted into the vagina of the user and the clitoral stimulation surface is in contact with the clitoral area of the user.
Figure 8B:
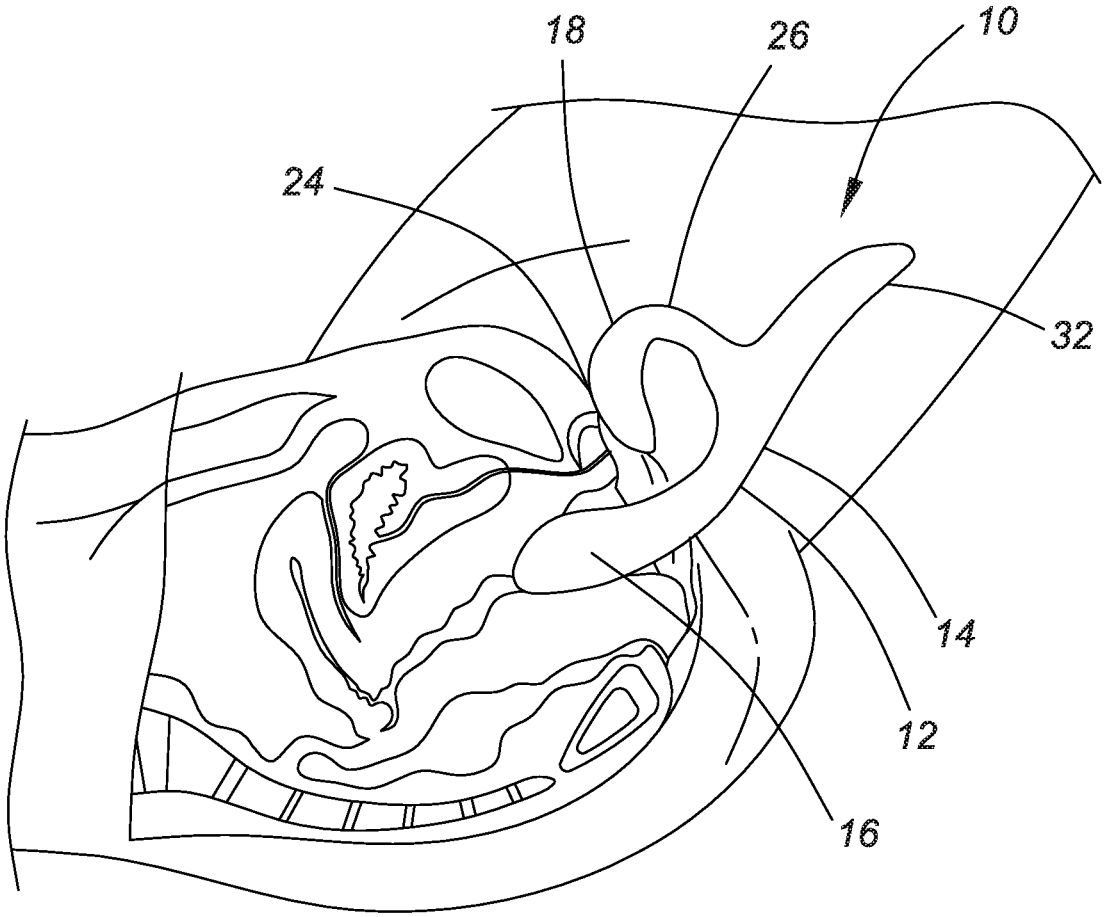
Figure 8C:
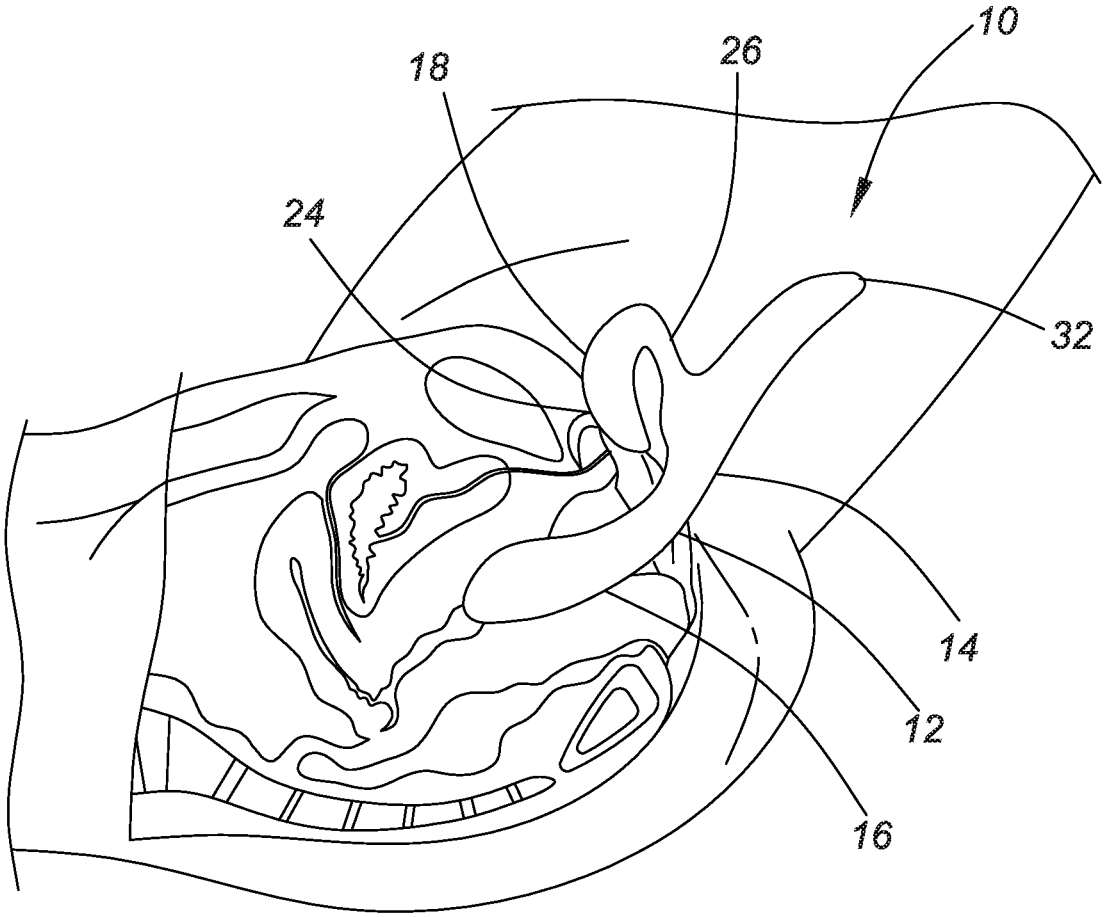

FIGS. 1-7, 8(*a*)-(*c*), and 9 (*a*)-(*c*) depict a specific embodiment of the present stimulation device, which is particularly suited to G-spot and clitoral stimulation. Device 10 includes an elongate member 12 comprising a proximal end 14 and a distal end 16, wherein the distal end 16 is dimensioned for placement in a vagina and particularly designed for internal G-spot stimulation. The device further includes an external stimulation arm shown as clitoral stimulation arm 18 comprising a proximal clitoral stimulation arm end 20, a distal clitoral stimulation arm end 22, and an external stimulation surface shown as clitoral stimulation surface or pad 24. The clitoral stimulation arm 18 and elongate member 12 are connected at their respective proximal ends (14, 20) by a flexible connecting portion 26. The flexible connecting portion 26 permits movement of the clitoral stimulation arm 18 relative to the elongate member 12 between: an open position, as exemplified in FIGS. 1-7, 8(*a*) and 9(*a*), wherein the distal clitoral stimulation arm end 22 is spaced apart from the proximal end 14 of the elongate member 12; and a compressed position, as exemplified in FIGS. 8(*c*) and 9(*c*), wherein the distal clitoral stimulation arm end 22 is in close proximity to the proximal end 14 of the elongate member 12. FIGS. 8(*b*) and 9(*b*) illustrate the device 10 in a partially compressed position.

The flexible connecting portion 26 can be either resilient or malleable, and preferably at least a portion of the flexible connecting portion 26 is resilient such that the connecting portion is resiliently flexible. The flexible connecting portion 26 can maintain the distal clitoral stimulation arm end 22 resiliently spaced apart from the proximal end 14 of the elongate member 12 in the open position and/or resiliently urge the distal clitoral stimulation arm end 22 away from the proximal end 14 of the elongate member 12 when the clitoral stimulation arm 18 is moved toward the compressed position.

As noted above, when in the open position, the flexible connecting portion 26 together with the clitoral stimulation arm 18 and the elongate member 12 define a gap therebetween. The flexible connecting portion 26 together with the proximal clitoral stimulation arm end 20 and the proximal end 14 of the elongate member 12 can define a general U-shape or C-shape in the open position. When in the compressed position, the gap defined by the flexible connecting portion 26 together with the clitoral stimulation arm 18 and the elongate member 12 is decreased.

Figure 9A:
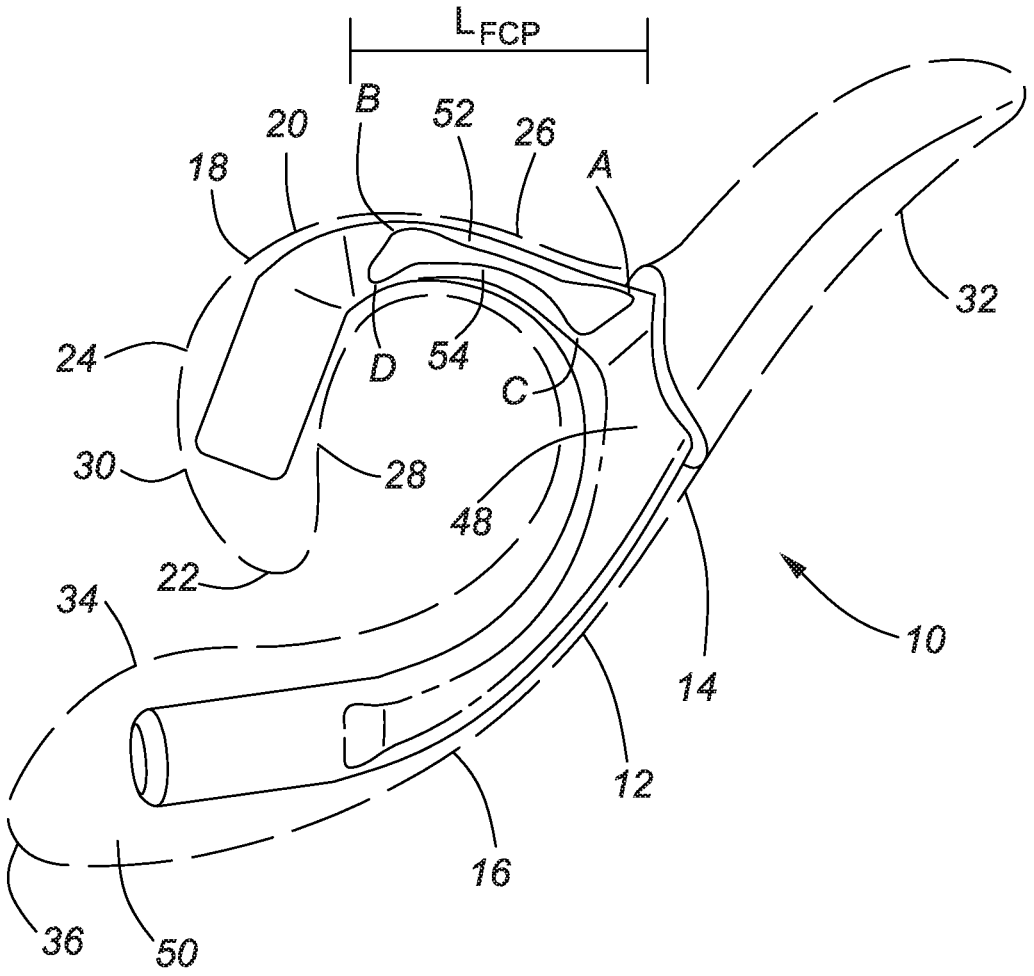
FIGS. 9(*a*)-(*c*) depict a simplified side view of the stimulation device shown in FIG. 1, with a transparent outer layer so that the internal skeleton is visible.
Figure 9B:
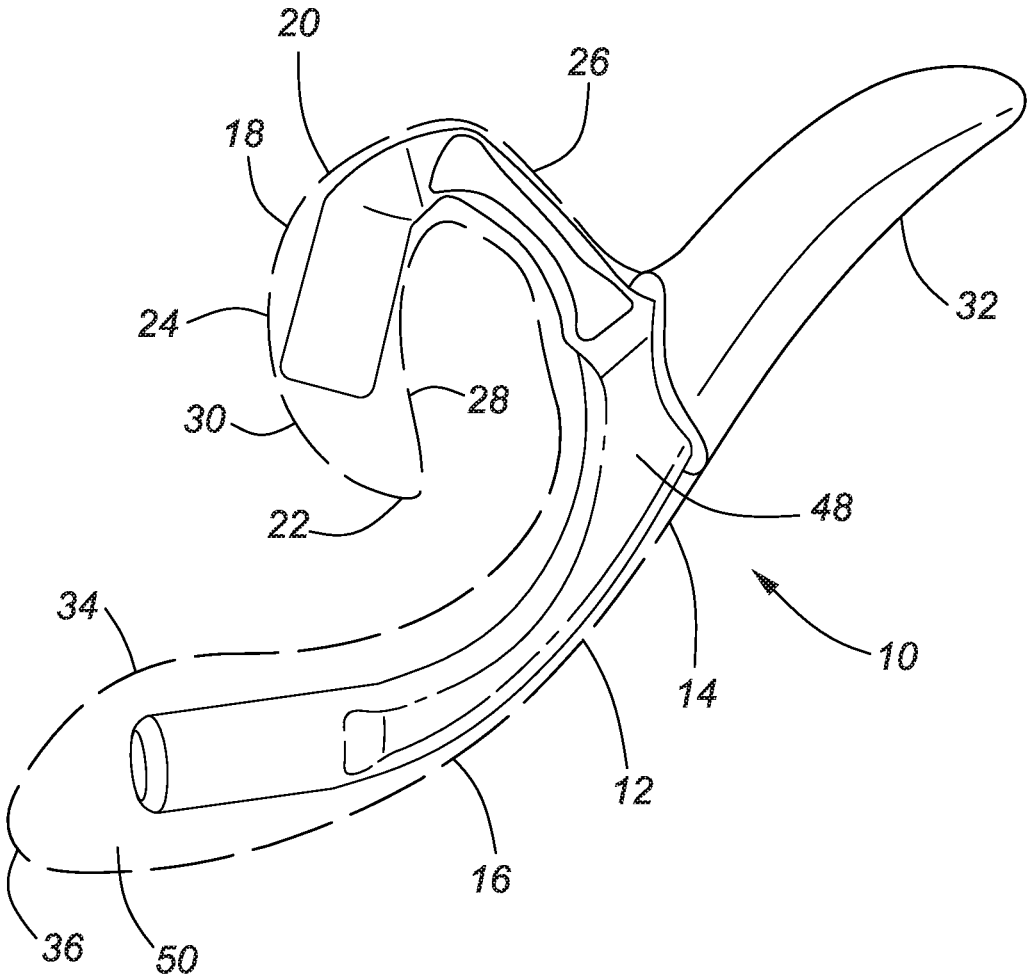
Figure 9C:
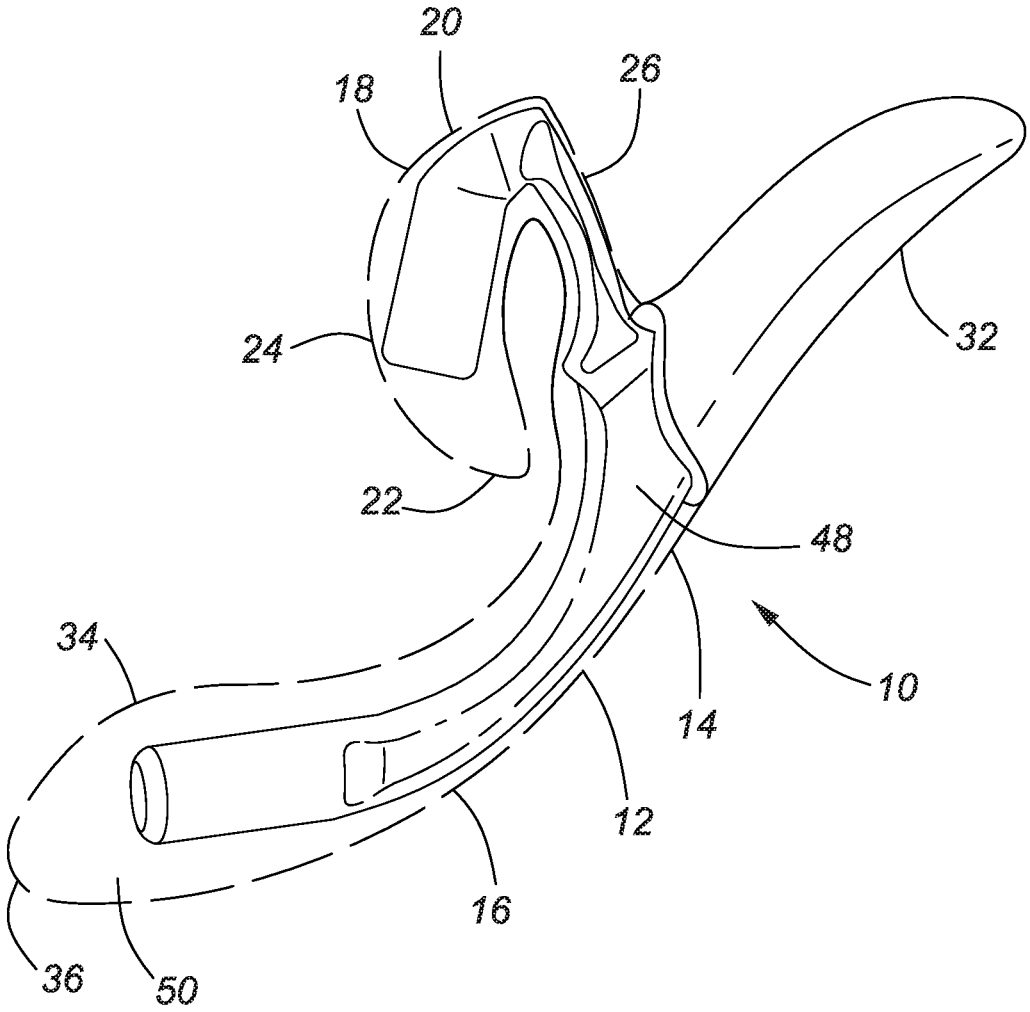

In a specific, non-limiting example, the length $L_{FCP}$ of the flexible connecting portion 26 extending between the proximal end 14 of the elongate member 12 and the proximal clitoral stimulation arm end 20 of the clitoral stimulation arm 18 as shown in FIG. 9(*a*) is from about 20 mm to about 70 mm, or from about 40 mm to about 50 mm. As shown in FIGS. 1-7, 8(*a*)-(*c*), and 9(*a*)-(*c*), the flexible connecting portion 26 can have a curved shape.

Figure 3:
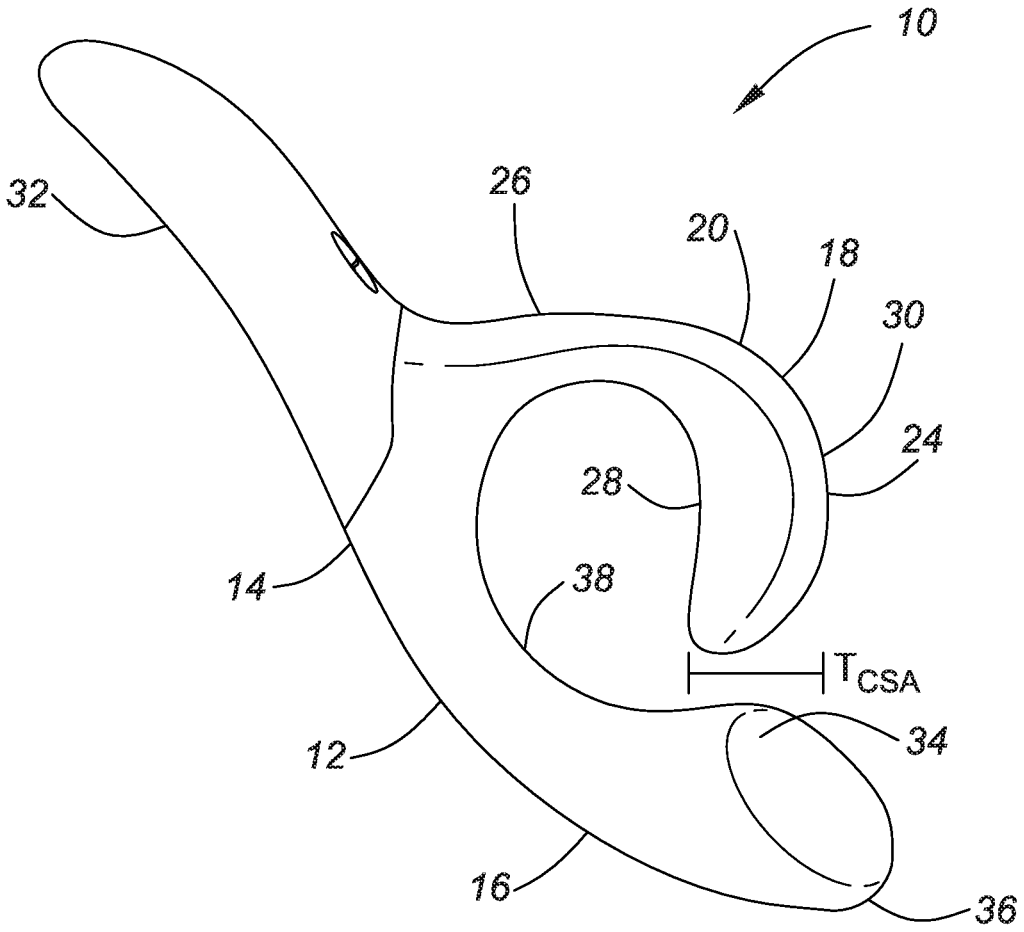
FIG. 3 is the opposite side view of the stimulation device shown in FIG. 1, in an open position.
Figure 4:
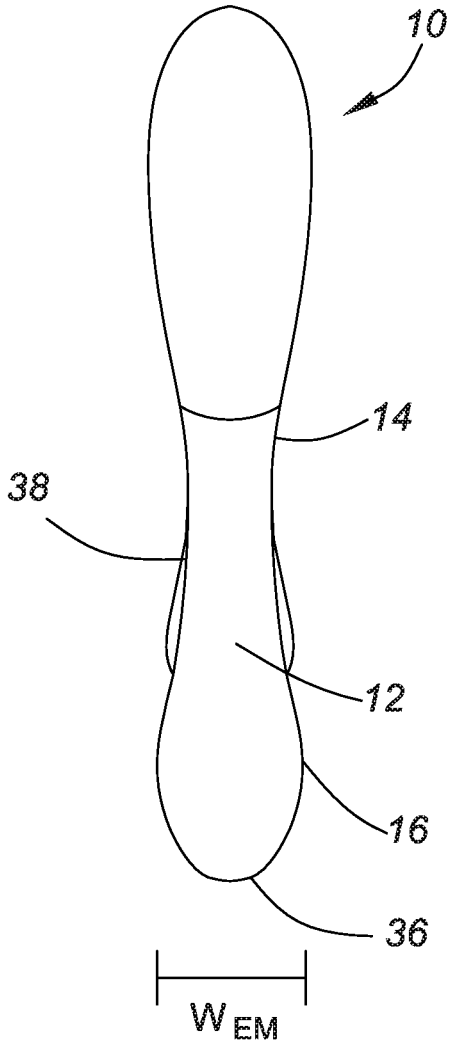
FIG. 4 is a rear view of the stimulation device shown in FIG. 1, in an open position.
Figure 5:
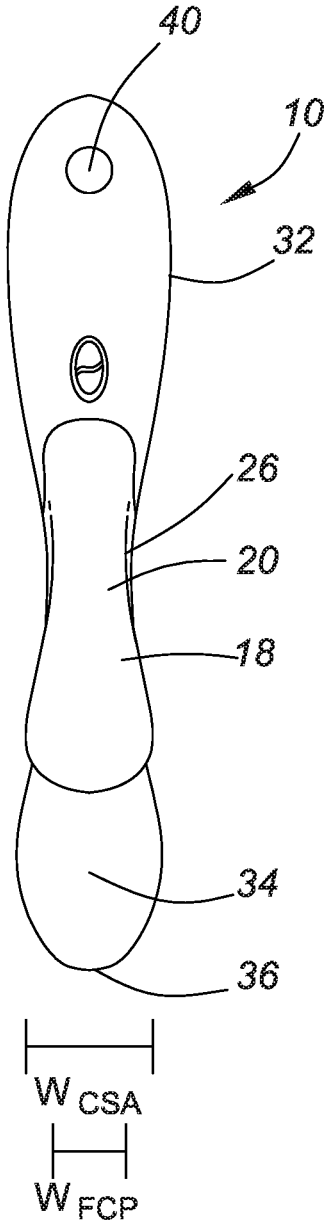
FIG. 5 is a front view of the stimulation device shown in FIG. 1, in an open position.

In another specific, non-limiting example, the width $W_{FCP}$ of the flexible connecting portion 26 measured between the two side edges of the flexible connecting portion 26 (i.e. left-to-right) as device 10 is viewed from the front as depicted in FIG. 5 is from about 5 mm to about 35 mm, or from about 10 mm to about 25 mm, or from about 15 mm to about 20 mm. As shown in FIGS. 1-7, 8(*a*)-(*c*), and 9(*a*)-(*c*), the width of the flexible connecting portion 26 can taper in from the points of attachment of the flexible connecting portion 26 to each of the proximal end 14 of the elongate member 12 and the proximal clitoral stimulation arm end 20 of the clitoral stimulation arm 18.

Figure 2:
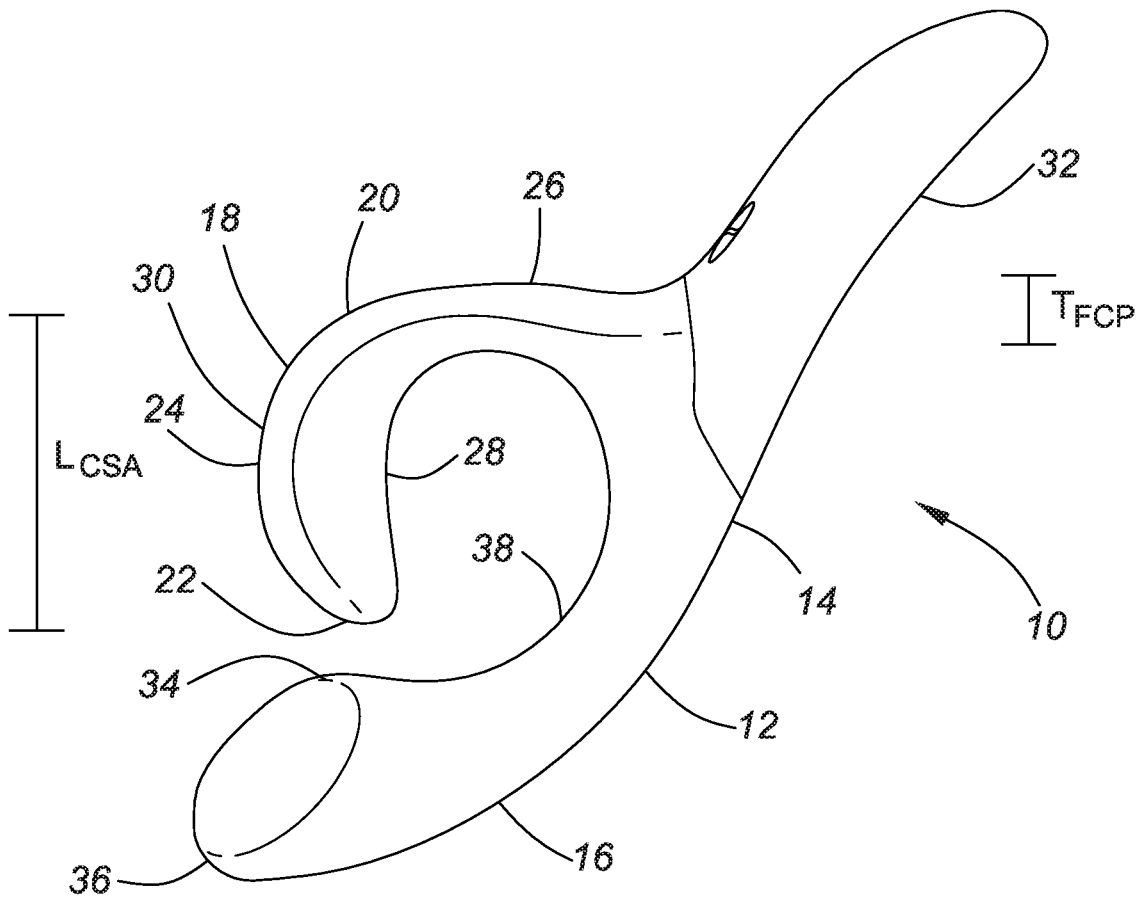
FIG. 2 is a side view of the stimulation device shown in FIG. 1, in an open position.

In yet another specific, non-limiting example, the thickness $T_{FCP}$ of the flexible connecting portion 26 measured between the top and bottom edges of the flexible connecting portion 26 as device 10 is viewed from the side as shown in FIG. 2 is from about 5 mm to about 20 mm, or from about 8 mm to about 12 mm. As shown in FIGS. 1-7, 8(*a*)-(*c*), and 9(*a*)-(*c*), the thickness of the flexible connecting portion 26 can taper in from the points of attachment of the flexible connecting portion 26 to each of the proximal end 14 of the elongate member 12 and the proximal clitoral stimulation arm end 20 of the clitoral stimulation arm 18.

The clitoral stimulation arm 18 is configured for contact with a woman's clitoris and/or the surrounding clitoral area, in order to provide clitoral stimulation during use. The clitoral stimulation arm 18 comprises an inner face 28 that faces the proximal end 14 of the elongate member 12 when the device is in the open position, and an outer face 30 opposite from the inner face 28, and the clitoral stimulation surface 24 extends along at least a portion of the outer face 30 of the clitoral stimulation arm 18. The clitoral stimulation surface 24 is designed to be in at least partial contact with a woman's clitoral area during use, and in particular embodiments in at least partial contact with the clitoris during use. The flexible connecting portion 26 facilitates the constant, or substantially constant, contact between clitoral stimulation surface 24 and the woman's clitoral area during use, because of the range of motion afforded by the flexible connection. In this context, the term "substantially constant" is used to recognize the fact that due to movement of the user, the present device may occasionally come out of contact with the clitoral area during use of the device, or may be intentionally removed from contact with the clitoral area at times during use (for example, to delay orgasm). The clitoral stimulation surface 24 can be smooth, or can have raised bumps, raised waves, raised concentric circles, nubbies, or any other texture desired.

In a specific, non-limiting example, the length $L_{CSA}$ of the clitoral stimulation arm 18 from the proximal clitoral stimulation arm end 20 to the distal clitoral stimulation arm end 22 as device 10 is viewed from the side as shown in FIG. 2 is from about 35 mm to about 75 mm, or from about 50 mm to about 60 mm.

In another specific, non-limiting example, the width $W_{CSA}$ of the clitoral stimulation arm 18 at its widest point is from about 20 mm to about 40 mm, or from about 25 mm to about 35 mm. The width of the clitoral stimulation arm 18 is measured between the two side edges of the clitoral stimulation arm 18 (i.e. left-to-right), as device 10 is viewed from the front as depicted in FIG. 5. As shown in FIGS. 1-7, 8(*a*)-(*c*), and 9(*a*)-(*c*), the clitoral stimulation arm 18 can taper in width towards the proximal clitoral stimulation arm end 20 and the distal clitoral stimulation arm end 22.

In yet another specific, non-limiting example, the thickness $T_{CSA}$ of the clitoral stimulation arm 18 at its thickest point is from about 15 mm to about 35 mm, or from about 20 mm to about 30 mm. The thickness of the clitoral stimulation arm 18 is measured between the inner face 28 and the outer face 30 of the clitoral stimulation arm 18 as device 10 is viewed from the side, as depicted in FIG. 3. As shown in FIGS. 1-7, 8(*a*)-(*c*), and 9(*a*)-(*c*), the clitoral stimulation arm 18 can taper in thickness towards the proximal clitoral stimulation arm end 20 and the distal clitoral stimulation arm end 22.

As shown in FIGS. 1-7, 8(*a*)-(*c*), and 9(*a*)-(*c*), the clitoral stimulation arm 18 can have a curved shape. In the embodiment shown in FIGS. 1-7, 8(*a*)-(*c*), and 9(*a*)-(*c*), the inner face 28 is concave and the outer face 30 is convex.

The device 10 further includes a handle 32 disposed on the proximal end 14 of the elongate member 12, which allows the user to hold the device in place and manually move the distal end 16 of the elongate member 12 in and out of, and within, the vagina. The handle 32 can be integrally formed with the elongate member 12, or it can be a separate attachment as discussed further below. Optionally, the grip or gripping region of the handle 32 includes ridges or other ergonomically shaped indentations for easy gripping during use. In the embodiment shown in FIGS. 1-7, 8(*a*)-(*c*) and 9(*a*)-(*c*), the handle 32 extends outwardly from the proximal end 14 of the elongate member 12 such that the handle 32 and the elongate member 12 form a generally sigmoidal shape in side view.

As described above, the distal end 16 of the elongate member 12 is dimensioned for insertion in the vagina and includes a region that is specifically designed for stimulation of the G-spot. In this embodiment, the distal end 16 of the elongate member 12 includes G-spot stimulation region 34 that is an inwardly curved flared portion. However, the G-spot stimulation region 34 can include various shapes, such as, for example, an inwardly curved hook or bend or a bulbous head. As shown in FIGS. 1-7, 8(*a*)-(*c*) and 9(*a*)-(*c*), the distal end 16 of the elongate member 12 terminates in a rounded tip 36. As with the clitoral stimulation surface 24, the outer surfaces of the elongate member 12 can be smooth, or can be textured in whole or in part.

In a specific, non-limiting example, the length $L_{EM}$ of the elongate member 12 from the proximal end 14 (from the area of attachment of the flexible connecting portion 26) to the rounded tip 36 as device 10 as viewed from the side as shown in FIG. 6 is from about 100 mm to about 250 mm, or from about 140 mm to about 200 mm, or from about 160 mm to about 180 mm.

In another specific, non-limiting example, the width $W_{EM}$ of the elongate member 12 at its widest point as device 10 is viewed from the back as shown in FIG. 4 is from about 15 mm to about 40 mm, or from about 30 mm to about 35 mm. As shown in FIGS. 1-7, 8(*a*)-(*c*), and 9(*a*)-(*c*), the elongate member 12 can taper in width from the G-spot stimulation region 34 towards the rounded tip 36, as well as from the G-spot stimulation region 34 toward the middle 38 of the elongate member 12, and can increase in width again at or near the area of attachment of the flexible connecting portion 26.

In yet another specific, non-limiting example, the thickness $T_{EM}$ of the elongate member 12 at its thickest point, e.g. in the G-spot stimulation region 34, as device 10 is viewed from the side as shown in FIG. 7 is from about 15 mm to about 40 mm, or from about 35 mm to about 40 mm. Devices having a greater thickness of the elongate member can be designed to have a lesser width according to user comfort and preferences, and vice versa. As shown in FIGS. 1-7, 8(*a*)-(*c*), and 9(*a*)-(*c*), the elongate member 12 can taper in thickness from the G-spot stimulation region 34 towards the rounded tip 36, as well as from the G-spot stimulation region 34 toward the middle portion 38 of the elongate member 12, and can increase in thickness again at or near the area of attachment of the flexible connecting portion 26.

It will, of course, be understood that the above-noted dimensions can be modified as desired to suit user preferences or manufacturing requirements.

The fact that the elongate member 12 generally tapers down in width and thickness from its widest, thickest portion at G-spot stimulation region 34 towards the middle portion 38 of the elongate member 12 permits a broad range of motion of the device during use, since the narrowed middle portion 38 of the elongate member 12 is sufficiently narrow to permit movement within the entrance to the vagina. This allows for greater maneuverability of the device. It is known that women (and men) vary slightly in their genital dimensions, and the overall maneuverability of the present device can account for such variations in genital anatomy.

Switch mechanism 40 is located in the distal end of the handle 32. As described further below, switch 40 is used to turn on and off and otherwise control one or more vibrational sources located within elongate member 12, flexible connecting portion 26, and/or clitoral stimulation arm 18. In the embodiment shown in FIGS. 6 and 7, the device 10 includes two longitudinally oriented vibrational motors 42 as the vibrational sources. The handle 32 of device 10 further houses a battery or batteries 44, as well as a recharging outlet 46 for recharging the battery or batteries 44.

As shown in FIGS. 6, 7, and 9(*a*)-(*c*), the device 10 comprises an internal skeleton 48 formed from, for example, molded plastic, a thermoplastic polymer, a resilient plastic, and/or pre-shaped metal (such as shape memory alloys (e.g. NiTi or the like), malleable metals (e.g. iron or aluminum), or resilient metals (e.g. stainless steel)) so that a portion of the body as well as the outer layer (designated as 50 in FIGS. 6, 7, and 9(*a*)-(*c*)) can be made from a very soft material, such as a soft silicone, most preferably a medical-grade silicone. In another embodiment, the internal skeleton can be formed from a shape memory alloy, a thermoplastic polymer, or combinations thereof. In another embodiment, the internal skeleton can be formed from resilient materials, malleable materials, and combinations thereof. The internal skeleton 48 of the device shown in FIGS. 6, 7, and 9(*a*)-(*c*) extends from the clitoral stimulation arm 18, through the flexible connecting portion 26, to the elongate member 12. A metal skeleton can be useful in providing a malleable device which can retain its shape after the application of force thereon (the use of malleable materials allows a user to bend the device strategically so that it is the precise shape they want; normal use does not flex the device enough to cause it to appreciably take on a new shape (i.e. it keeps its shape after adjusting)). In some embodiments, the use of shape memory alloys can be useful in providing a resilient device, which springs back to its original shape after the application of force is removed. Further, the internal skeleton can be comprised of a combination of resilient and malleable materials. Polymers useful in the internal skeleton include, without limitation, polypropylene, polyethylene, polymethacrylics, and combinations thereof. Combinations of polymeric and metallic internal skeletons are also useful.

As can be seen in FIGS. 7 and 9(*a*)-(*c*), the internal skeleton 48 comprises a first arm 52 and a second arm 54 disposed within the flexible connecting portion 26, wherein: the first arm 52 is hingedly connected to a first portion of the internal skeleton 48 located at or near the proximal end 14 of the elongate member 12, at a first hinge point A, forming a first hinge; the first arm 52 is hingedly connected to a second portion of the internal skeleton 48 located at or near the proximal clitoral stimulation arm end 20 of the clitoral stimulation arm 18, at a second hinge point B, forming a second hinge; the second arm 54 is hingedly connected to a third portion of the internal skeleton 48 located at or near the proximal end 14 of the elongate member 12, at a third hinge point C, forming a third hinge; the second arm 54 is hingedly connected to a fourth portion of the internal skeleton 48 located at or near the proximal clitoral stimulation arm end 20 of the clitoral stimulation arm 18 at a fourth hinge point D, forming a fourth hinge; wherein, in side view, the first, second, third, and fourth hinge points together define a quadrangular shape, preferably a generally trapezoidal or generally parallelogram shape (i.e. lines drawn between adjacent hinge points A-D as noted above define a quadrangular, preferably a generally trapezoidal or generally parallelogram, shape). As can be seen from the above-noted Figures, the first arm 52 is disposed on the "top" side of the flexible connecting portion 26, and the second arm 54 is disposed on the "bottom" side of the flexible connecting portion 26 (wherein the "top" of the device is denoted by the handle 32) creating a gap therebetween. In one embodiment, the first arm 52 and second arm 54 can be substantially parallel.

FIGS. 8(*a*)-(*c*) depict a simplified side view of the stimulation device shown in FIGS. 1-7 and 9(*a*)-(*c*) engaged with a female user, wherein the distal end 16 of the elongate member 12 is inserted into the vagina of the user and the clitoral stimulation surface 24 is in contact with the clitoral area of the user. FIG. 8(*a*) depicts the stimulation device in an open position. FIG. 8(*b*) depicts the stimulation device in a partially compressed position. FIG. 8(*c*) depicts the device in a compressed position. As can be seen from FIGS. 8(*a*)-(*c*) and FIGS. 9(*a*)-(*c*), the arrangement of the first arm 52 and second arm 54 in the portion of the internal skeleton 48 disposed within the flexible connecting portion 26 provides a relatively linear motion of the clitoral stimulation arm 18 between the open and compressed positions. Thus, in use, the distal end 16 of the elongate member 12 can provide friction and vibration when inserted into the vagina of the user, while the clitoral stimulation arm 18 can also vibrate and maintain constant, or substantially constant, contact between the clitoral stimulation surface 24 and the woman's clitoral area while the distal end 16 of the elongate member 12 moves in and out and within the vagina, because of the range of motion afforded by the flexible connection. In one embodiment, the angle of the outer face 30 of the clitoral stimulation arm 18 does not substantially change as the device moves from an open to a compressed position.

As noted above, when a force is applied to the clitoral stimulation surface 24 of the clitoral stimulation arm 18, this effects movement of the clitoral stimulation arm 18 relative to the elongate member 12 towards the compressed position. When the force applied to the clitoral stimulation surface 24 of the clitoral stimulation arm 18 is decreased or removed, the device returns to the open position. In the absence of an applied force, the device remains in the open (resting)

position. The flexible connecting portion 26 can be either resilient or malleable, and preferably at least a portion of the connecting portion is resilient such that the connecting portion is resiliently flexible. The flexible connecting portion 26 can maintain the distal clitoral stimulation arm end 22 resiliently spaced apart from the proximal end 14 of the elongate member 12 in the open position and/or resiliently urge the distal clitoral stimulation arm end 22 away from the proximal end 14 of the elongate member 12 when the clitoral stimulation arm 18 is moved toward the compressed position. As shown in FIGS. 7 and 9(*a*)-(*c*), the internal skeleton comprises a first arm 52 and a second arm 54 disposed within the flexible connecting portion 26 comprising a first hinge, second hinge, third hinge, and fourth hinge which are spring-type hinges. As noted above, the internal skeleton can be comprised of a combination of resilient and malleable materials. In one embodiment, the portions of the internal skeleton located at or near the hinge points can be formed from malleable metal so that the position of the elongate member and clitoral stimulation arm can be adjusted according to user preferences.

Figure 10A:
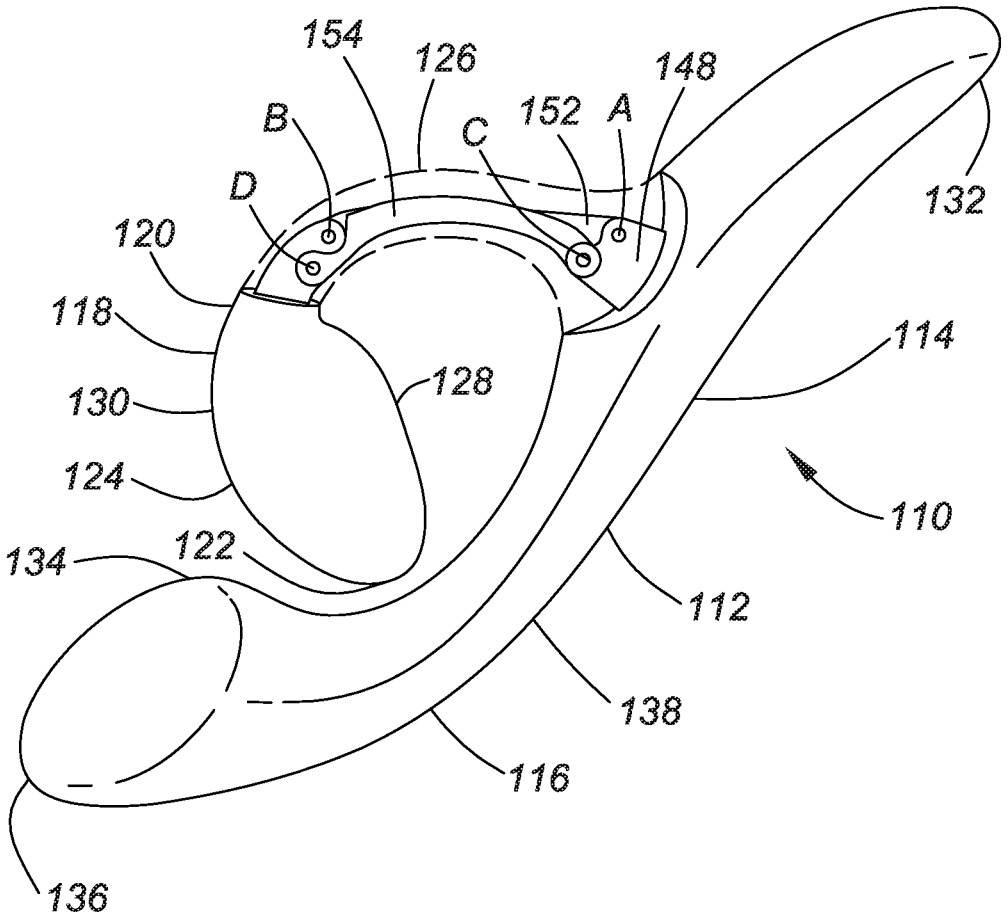
FIGS. 10(*a*)-(*c*) are simplified side views of a combination internal and external sexual stimulation device, according to another alternative embodiment of the present application, with the connecting portion having a transparent outer layer so that the internal skeleton is visible.
Figure 10B:
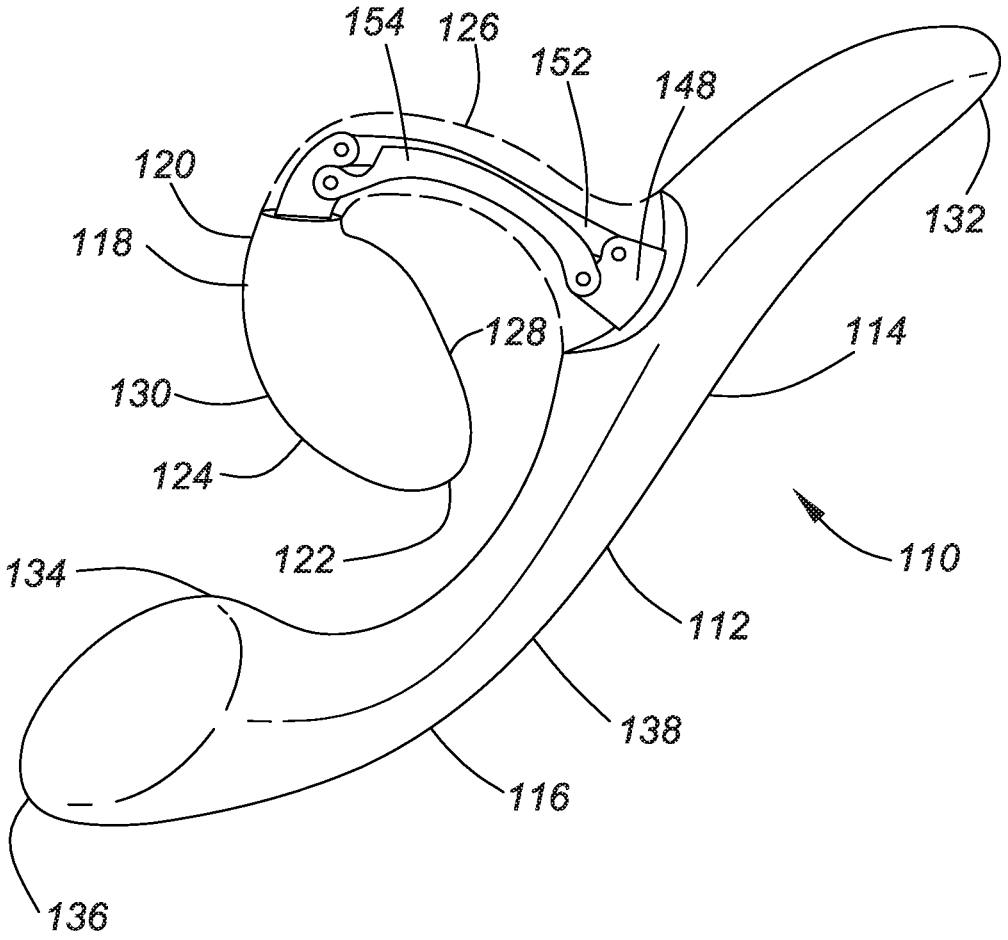
Figure 10C:
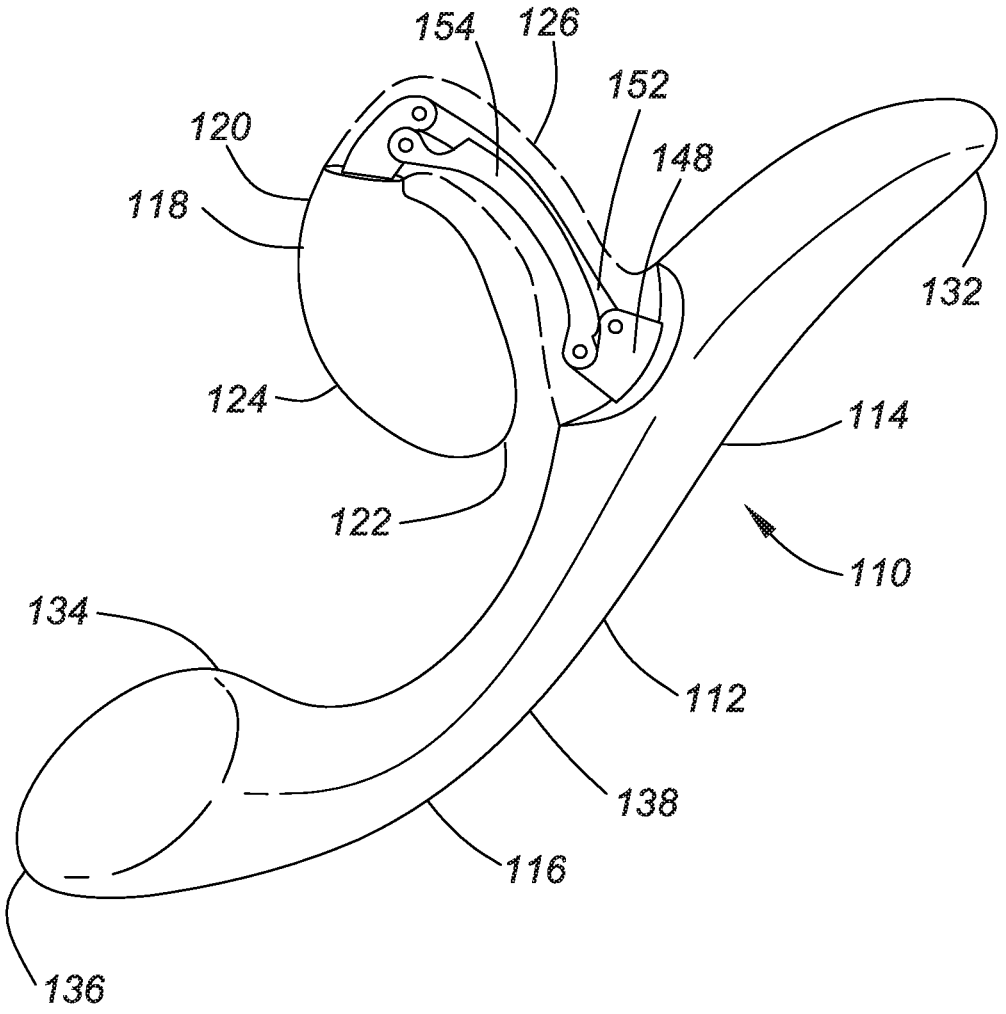

FIGS. 10(*a*)-(*c*) depict another embodiment of the present stimulation device, which is particularly suited to G-spot and clitoral stimulation. Device 110 includes an elongate member 112 comprising a proximal end 114 and a distal end 116, wherein the distal end 116 is dimensioned for placement in a vagina for internal G-spot stimulation. The device further includes an external stimulation arm shown as clitoral stimulation arm 118 comprising a proximal clitoral stimulation arm end 120, a distal clitoral stimulation arm end 122, and an external stimulation surface shown as clitoral stimulation surface or pad 124. The clitoral stimulation arm 118 and elongate member 112 are connected at their respective proximal ends (114, 120) by a flexible connecting portion 126. The flexible connecting portion 126 permits movement of the clitoral stimulation arm 118 relative to the elongate member 112 between: an open position, as exemplified in 10(*a*), wherein the distal clitoral stimulation arm end 122 is spaced apart from the proximal end 114 of the elongate member 112; and a compressed position, as exemplified in FIG. 10(*c*), wherein the distal clitoral stimulation arm end 122 is in close proximity to the proximal end 114 of the elongate member 112. FIG. 10(*b*) illustrates the device 110 in a partially compressed position.

As noted above, when in the open position, the flexible connecting portion 126 together with the clitoral stimulation arm 118 and the elongate member 112 define a gap therebetween. When in the compressed position, the gap defined by the flexible connecting portion 126 together with the clitoral stimulation arm 118 and the elongate member 112 is decreased.

The clitoral stimulation arm 118 is configured for contact with a woman's clitoris and/or the surrounding clitoral area, in order to provide clitoral stimulation during use. The clitoral stimulation arm 118 comprises an inner face 128 that faces the proximal end 114 of the elongate member 112 when the device is in the open position, and an outer face 130 opposite from the inner face 128, and the clitoral stimulation surface 124 extends along at least a portion of the outer face 130 of the clitoral stimulation arm 118. The clitoral stimulation surface 124 is designed to be in at least partial contact with a woman's clitoral area during use, and in particular embodiments in at least partial contact with the clitoris during use. The flexible connecting portion 126 facilitates the constant, or substantially constant, contact between clitoral stimulation surface 124 and the woman's clitoral area during use, because of the range of motion afforded by the flexible connection. The clitoral stimulation surface 124 can be smooth, or can have raised bumps, raised waves, raised concentric circles, nubbies, or any other texture desired.

As shown in FIGS. 10(*a*)-(*c*), the clitoral stimulation arm 118 can have a curved shape. In the embodiment shown in FIGS. 10(*a*)-(*c*), the inner face 128 and the outer face 130 are both convex.

The device 110 further includes a handle 132 disposed on the proximal end 114 of the elongate member 112, which allows the user to hold the device in place and manually move the distal end 116 of the elongate member 112 in and out of, and within, the vagina. The handle 132 can be integrally formed with the elongate member 112, or it can be a separate attachment as discussed further below. Optionally, the grip or gripping region of the handle 132 includes ridges or other ergonomically shaped indentations for easy gripping during use. In the embodiment shown in FIGS. 10(*a*)-(*c*), the handle 132 extends outwardly from the proximal end 114 of the elongate member 112 such that the handle 132 and the elongate member 112 form a generally sigmoidal shape in side view.

As described above, the distal end 116 of the elongate member 112 is dimensioned for insertion in the vagina and includes a region that is specifically designed for stimulation of the G-spot. In this embodiment, the distal end 116 of the elongate member 112 includes G-spot stimulation region 134 that is an inwardly curved flared portion. However, the G-spot stimulation region 134 can include various shapes, such as, for example, an inwardly curved hook or bend or a bulbous head. As shown in FIGS. 10(*a*)-(*c*), the distal end 116 of the elongate member 112 terminates in a rounded tip 136. As with the clitoral stimulation surface 124, the outer surfaces of the elongate member 112 can be smooth, or can be textured in whole or in part.

The fact that the elongate member 112 generally tapers down in width and thickness from its widest, thickest portion at G-spot stimulation region 134 towards the middle portion 138 of the elongate member 112 permits a broad range of motion of the device during use, since the narrowed middle portion 138 of the elongate member 112 is sufficiently narrow to permit movement within the entrance to the vagina. This allows for greater maneuverability of the device and can also account for the above-noted variations in genital anatomy.

The device 110 comprises an internal skeleton 148 formed from, for example, molded plastic, a thermoplastic polymer, a resilient plastic, and/or pre-shaped metal, having the same properties as noted above in respect of device 10. As noted above, in another embodiment, the internal skeleton can be formed from a shape memory alloy, a thermoplastic polymer, or combinations thereof. In another embodiment, the internal skeleton can be formed from resilient materials, malleable materials, and combinations thereof.

As can be seen in FIGS. 10(*a*)-(*c*), the internal skeleton 148 comprises a first arm 152 and a second arm 154 disposed within the flexible connecting portion 126, wherein: the first arm 152 is hingedly connected to a first portion of the internal skeleton 148 located at or near the proximal end 114 of the elongate member 112, at a first hinge point A, forming a first hinge; the first arm 152 is hingedly connected to a second portion of the internal skeleton 148 located at or near the proximal clitoral stimulation arm end 120 of the clitoral stimulation arm 118, at a second hinge point B, forming a second hinge; the second arm 154 is hingedly connected to a third portion of the internal skeleton 148 located at or near the proximal end 114 of the elongate member 112, at a third hinge point C, forming a third hinge; the second arm 154 is hingedly connected to a fourth portion of the internal skeleton 148 located at or near the proximal clitoral stimulation arm end 120 of the clitoral stimulation arm 118 at a fourth hinge point D, forming a fourth hinge; wherein, in side view, the first, second, third, and fourth hinge points together define a quadrangular shape, preferably a generally trapezoidal or generally parallelogram shape (i.e. lines drawn between adjacent hinge points A-D as noted above define a quadrangular, preferably a generally trapezoidal or generally parallelogram, shape). In the embodiment shown in FIGS. 10(*a*)-(*c*), each of the first, second, third, and fourth hinges are pivots. While the pivots form a mechanical hinge system that has excellent durability, if the flexible connecting portion 126 is to have resiliency, a spring force will be needed. In one embodiment, the spring force can be provided by an outer layer of silicone. In another embodiment, the spring force can be provided by a torsion spring or leaf spring located at one or more hinge points.

As noted above, when a force is applied to the clitoral stimulation surface 124 of the clitoral stimulation arm 118, this effects movement of the clitoral stimulation arm 118 relative to the elongate member 112 towards the compressed position. When the force applied to the clitoral stimulation surface 124 of the clitoral stimulation arm 118 is decreased or removed, the device returns to the open position, by virtue of a spring force such as the above-noted outer layer of silicone, or a torsion/leaf spring. In the absence of an applied force, the device remains in the open (resting) position. The flexible connecting portion 126 can be either resilient or malleable, and as noted above preferably at least a portion of the connecting portion is resilient such that the connecting portion is resiliently flexible. The flexible connecting portion 126 can maintain the distal clitoral stimulation arm end 122 resiliently spaced apart from the proximal end 114 of the elongate member 112 in the open position and/or resiliently urge the distal clitoral stimulation arm end 122 away from the proximal end 114 of the elongate member 112 when the clitoral stimulation arm 118 is moved toward the compressed position.

The other aspects of device 110 are otherwise as set out above in respect of device 10 with respect to internal components, outer layer, dimensions, mode of use, etc.

It will be appreciated that many options exist for configuring the flexible connecting portion of the stimulation device disclosed herein to achieve the desired spring force and range of motion of the device. FIGS. 11(*a*)-(*o*) illustrate side views of various contemplated arrangements for the portion of the internal skeleton that extends through the flexible connecting portion of the sexual stimulation device as herein described, each of the pictorials having an orientation such that the external stimulation arm (e.g. clitoral stimulation arm) would be disposed on the left-hand side of the flexible connecting portion, and the elongate member would be disposed on the right-hand side of the flexible connecting portion.

Table 1 briefly describes the various exemplary hinge systems shown in FIGS. 11(*a*)-(*o*). As outlined in Table 1, the use of different types and combinations of hinges, optionally in combination with an additional spring, provides a variety of spring forces and ranges of motion of the device. As well, certain hinge types can be expected to have a longer life than others, which can also be a factor when selecting a hinge system for use in the flexible connecting portion of the stimulation device.

TABLE 1

Figure 11A:
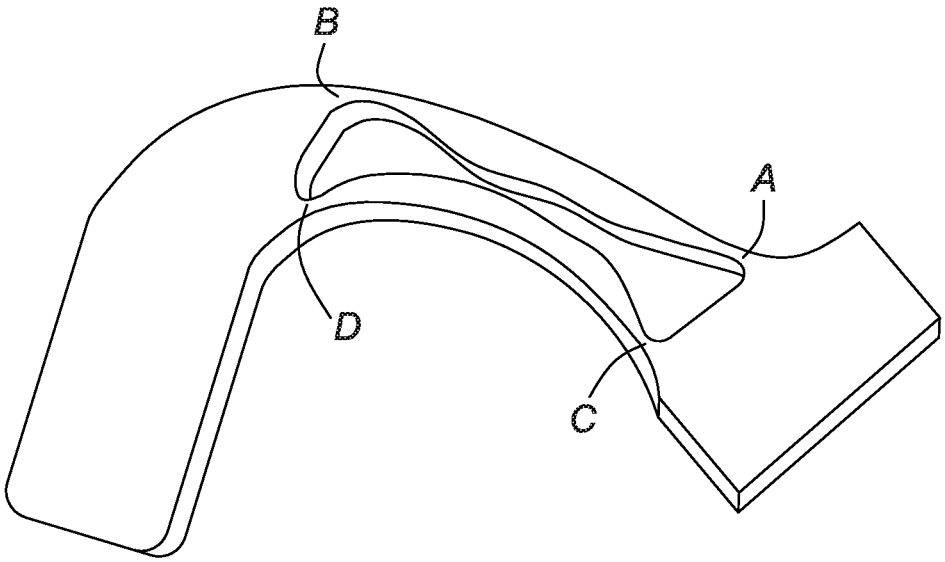
FIGS. 11(*a*)-(*o*) illustrate side views of various contemplated arrangements for the portion of the internal skeleton that extends through the flexible connecting portion of the sexual stimulation device as herein described, each of the pictorials having an orientation such that the external stimulation arm would be disposed on the left-hand side of the flexible connecting portion, and the elongate member would be disposed on the right-hand side of the flexible connecting portion.
Figure 11B:
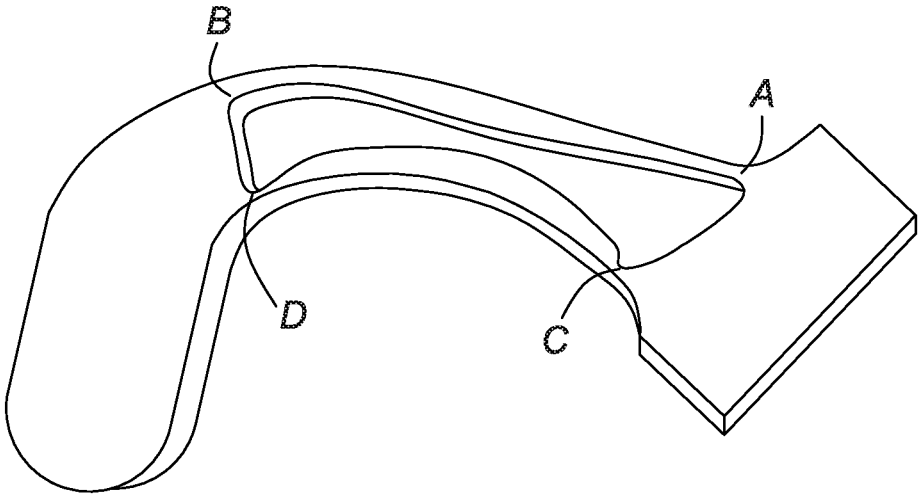
Figure 11C:
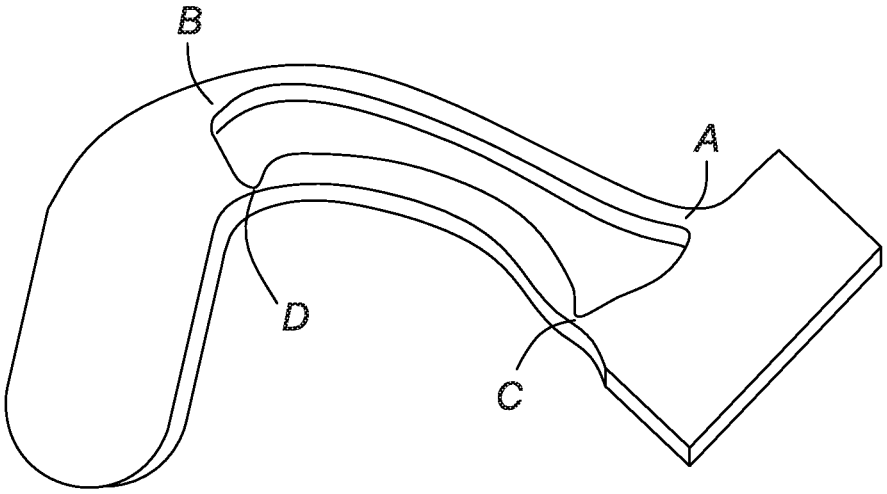
Figure 11D:
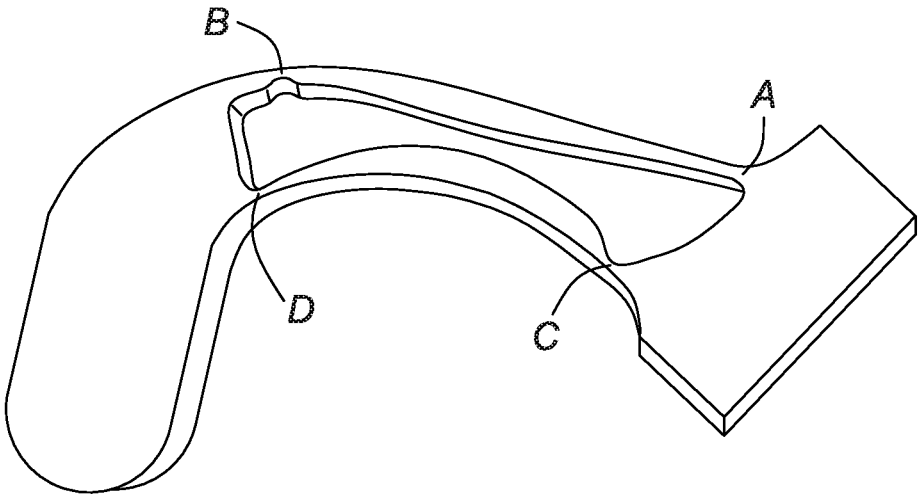
Figure 11E:
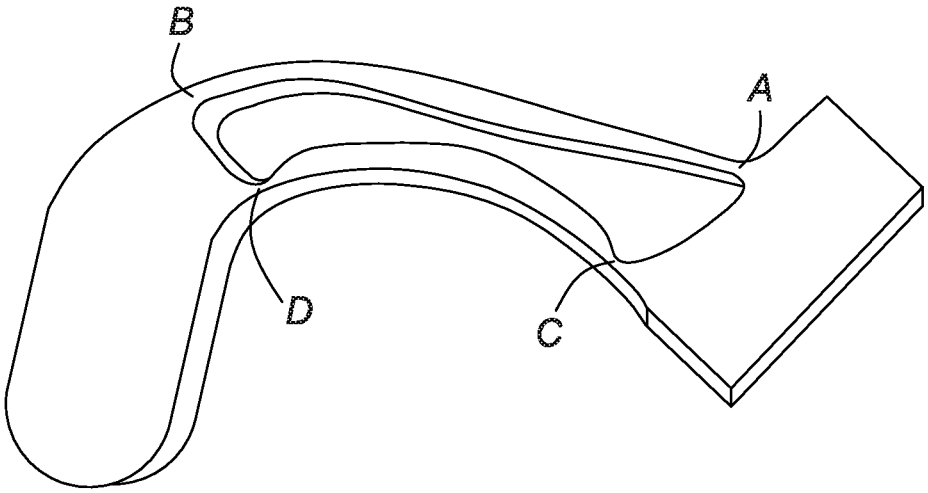
Figure 11F:
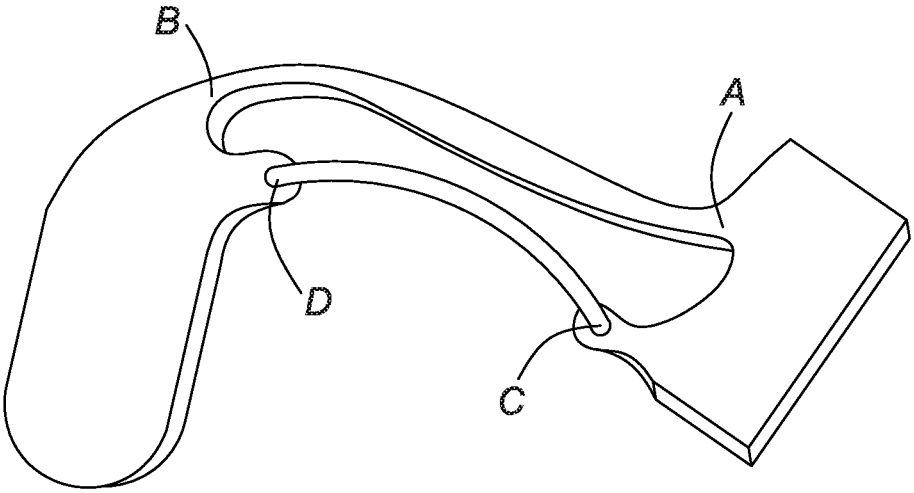
Figure 11G:
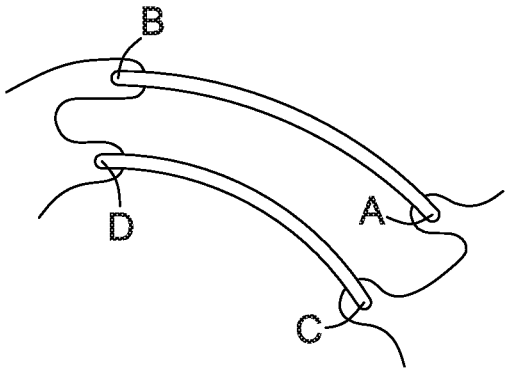
Figure 11H:
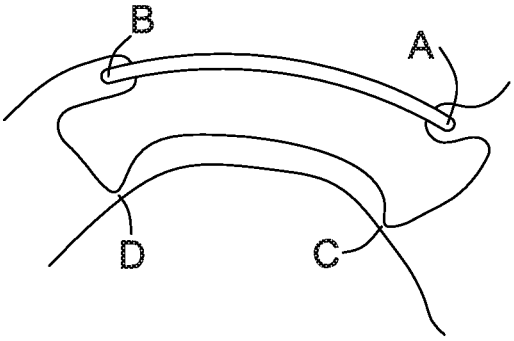
Figure 11I:
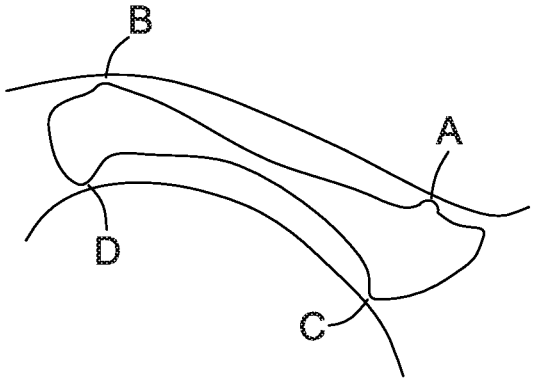
Figure 11J:
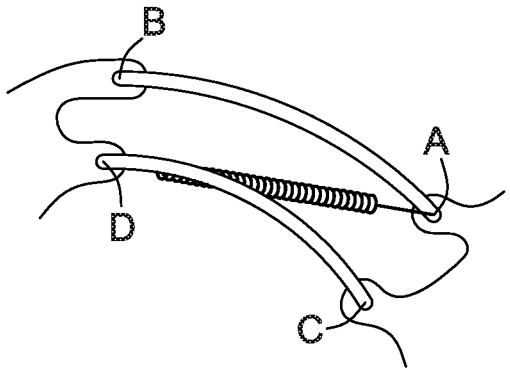
Figure 11K:
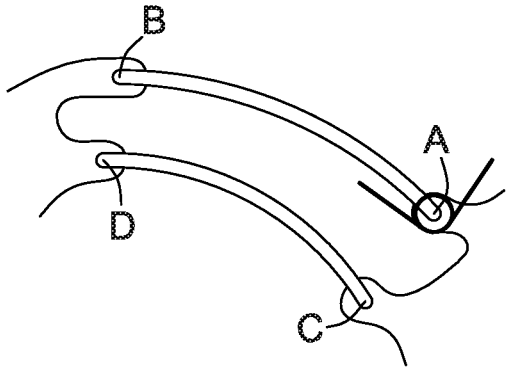
Figure 11L:
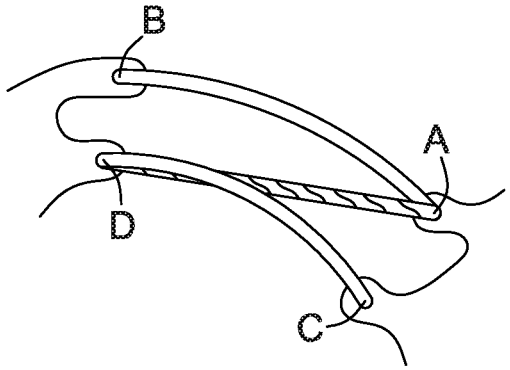
Figure 11M:
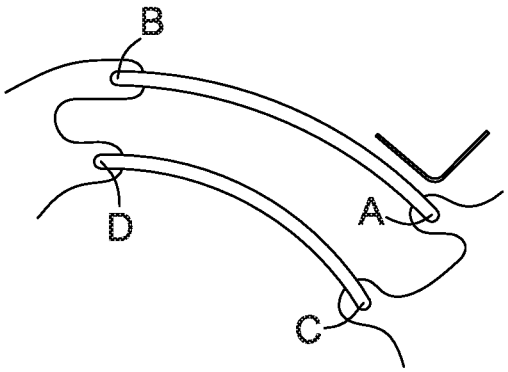
Figure 11N:
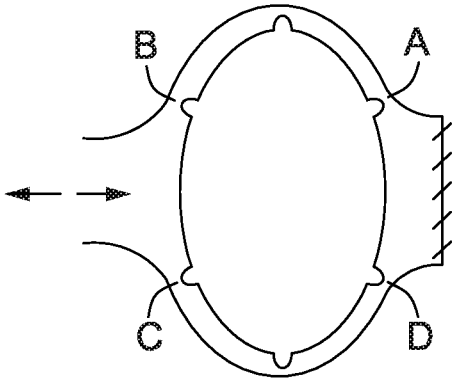
Figure 11O:
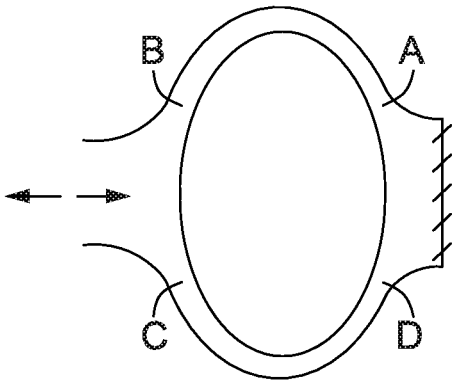

Hinge systems exemplified in FIGS. 11(a)-(o)

| | Hinge Type and Location | | | | |
|---|---|---|---|---|---|
| Figure | Hinge Point A | Hinge Point B | Hinge Point C | Hinge Point D | Notes |
| 11(a) | Spring-type Hinge | Spring-type Hinge | Spring-type Hinge | Spring-type Hinge | A very stiff system; note that spring-type hinges may be susceptible to wear and tear due to stresses on the plastic. |
| 11(b) | Spring-type Hinge | Spring-type Hinge | Living Hinge | Living Hinge | Using the living hinges at hinge points C and D increases the life of the system relative to system of FIG. 11(a), but also reduces the stiffness. |
| 11(c) | Spring-type Hinge | Spring-type Hinge | Living Hinge | Living Hinge | By tapering the spring-type hinges in the middle, the kinematics can be improved (i.e. the external stimulation arm can move in a more linear fashion) relative to system of FIG. 11(b). |
| 11(d) | Spring-type Hinge | Living Hinge | Living Hinge | Living Hinge | By putting a living hinge on hinge point B, the life and kinematics can be improved relative to system of FIG. 11(c), but at the cost of stiffness. |
| 11(e) | Spring-type Hinge | Spring-type Hinge | Living Hinge | Living Hinge | By increasing the length of the spring-type hinges the life of the hinges can be increased. |
| 11(1) | Spring-type Hinge | Spring-type Hinge | Pivot | Pivot | Replacing the living hinges with pivots and a separate link/arm increases the life of the system relative to the |

TABLE 1-continued

| Hinge systems exemplified in FIGS. 11(a)-(o) | | | | | |
|---|---|---|---|---|---|
| | Hinge Type and Location | | | | |
| Figure | Hinge Point A | Hinge Point B | Hinge Point C | Hinge Point D | Notes |
| | | | | | system of FIG. 11(e). By using the spring-type hinges on the other link/arm the system has its spring. |
| 11(g) | Pivot | Pivot | Pivot | Pivot | Having four pivots at the four hinge points allows the kinematics to be precisely controlled and creates a system with excellent lifespan. A separate spring needs to be added to add the spring force. |
| 11(h) | Pivot | Pivot | Living Hinge | Living Hinge | Replacing the spring-type hinges with pivots eliminates the spring force and increases the life of the system relative to the system shown in FIG. 11(f). This system will require an additional spring to create the spring force |
| 11(i) | Living Hinge | Living Hinge | Living Hinge | Living Hinge | Using 4 living hinges provides excellent durability with one plastics part; a separate spring would be required for the spring force. |
| 11(j) | Pivot | Pivot | Pivot | Pivot | This system uses a compression spring placed to create a spring force in the desired direction. A tension spring could also be used, but would run from points B and C. |
| 11(k) | Pivot | Pivot | Pivot | Pivot | This system uses a torsion spring or springs which can be placed at any of the pivot points or at multiple pivot points to give the spring force. |
| 11(l) | Pivot | Pivot | Pivot | Pivot | This system uses a silicone strip placed to act as a compression spring to create a spring force in the desired direction. Alternately, a silicone strip acting as a tension silicone spring could be placed to run from points B and C. |
| 11(m) | Pivot | Pivot | Pivot | Pivot | This system uses a leaf spring placed to create a spring force in the desired direction. |
| 11(n) | Living Hinge | Living Hinge | Living Hinge | Living Hinge | This system enables near-perfect linear movement of the external stimulation arm using 3 living hinges on each arm. Would need additional spring force to provide flexible resiliency (e.g. silicone or coil spring). |
| 11(o) | Spring-type Hinge | Spring-type Hinge | Spring-type Hinge | Spring-type Hinge | This system enables near-perfect linear movement of the external stimulation arm using both arms as a large spring-type hinge. |

It will be understood by those of skill in the art that for embodiments of the stimulation device including a flexible connecting portion having an inner skeleton such as that shown in FIGS. 11(*n*) and 11(*o*), the width and/or thickness of the flexible connecting portion can be adjusted to accommodate the outward movement of the arms as the external stimulation arm moves towards the compressed position. Also, while shown in side view, it will be understood that the hinge systems shown in FIGS. 11(*n*) and 11(*o*) can also operate in other orientations (e.g. in a plane perpendicular to the one shown).

Figure 12A:
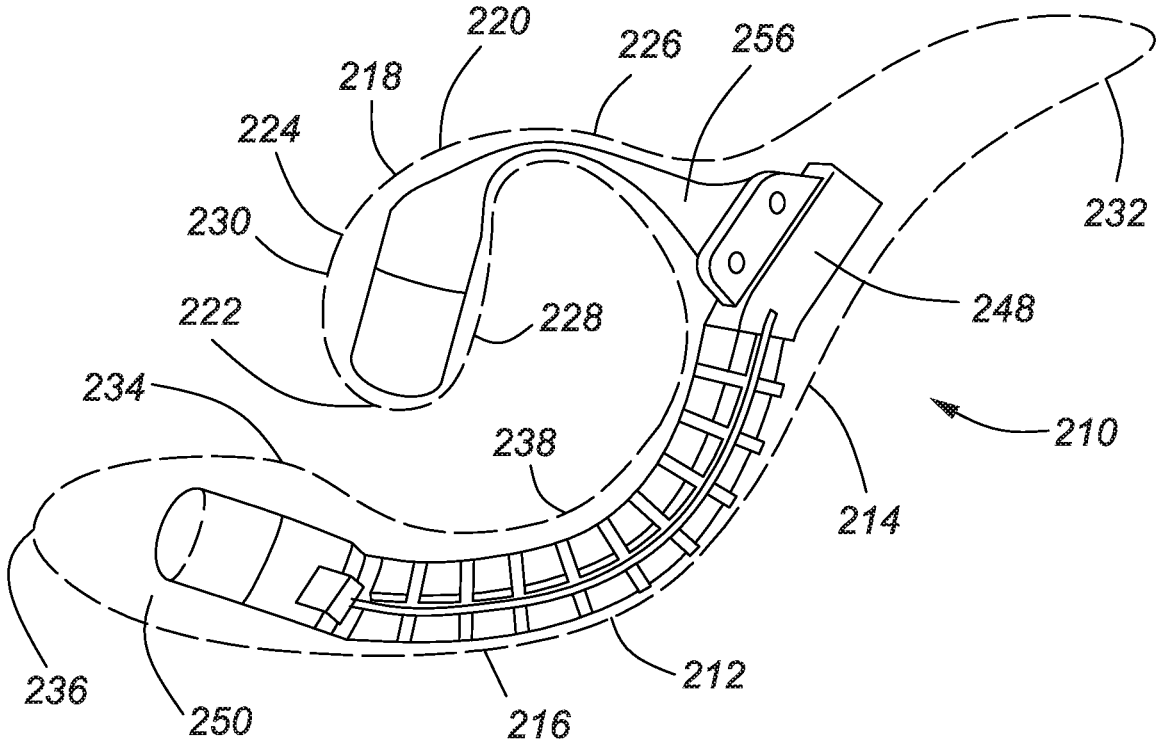
FIGS. 12(*a*)-(*c*) are simplified side views of a combination internal and external sexual stimulation device, according to another alternative embodiment of the present application, having a transparent outer layer so that the internal skeleton is visible.
Figure 12B:
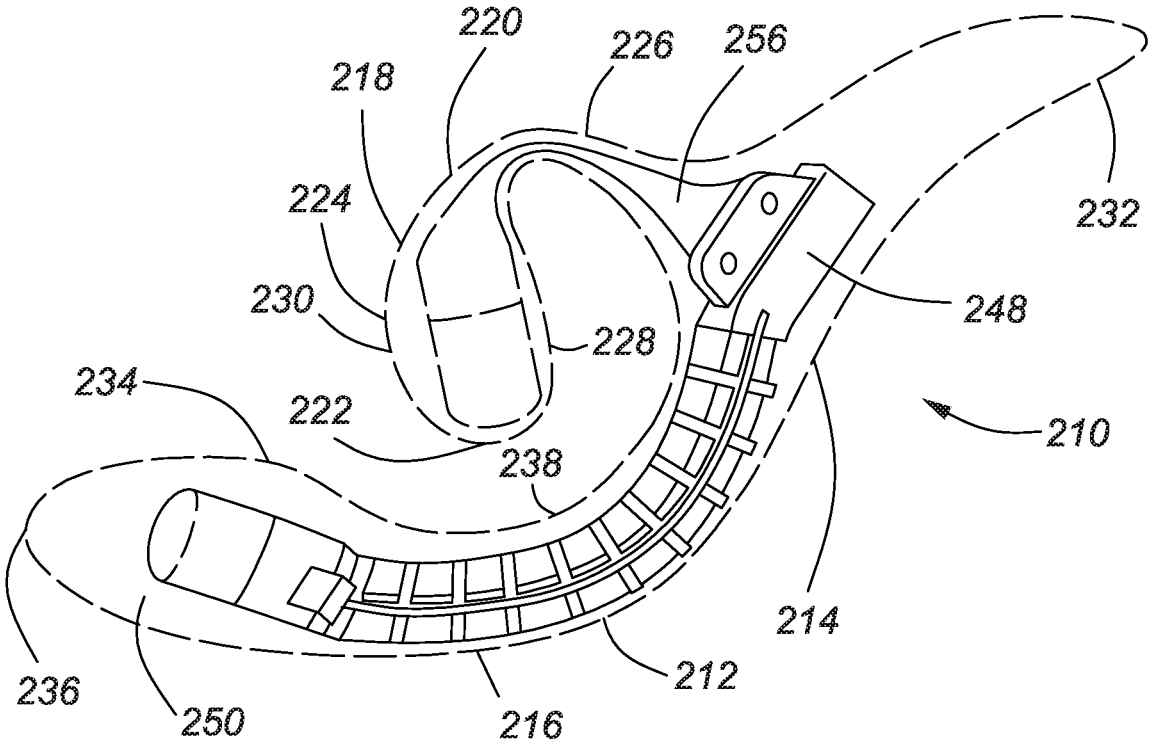
Figure 12C:
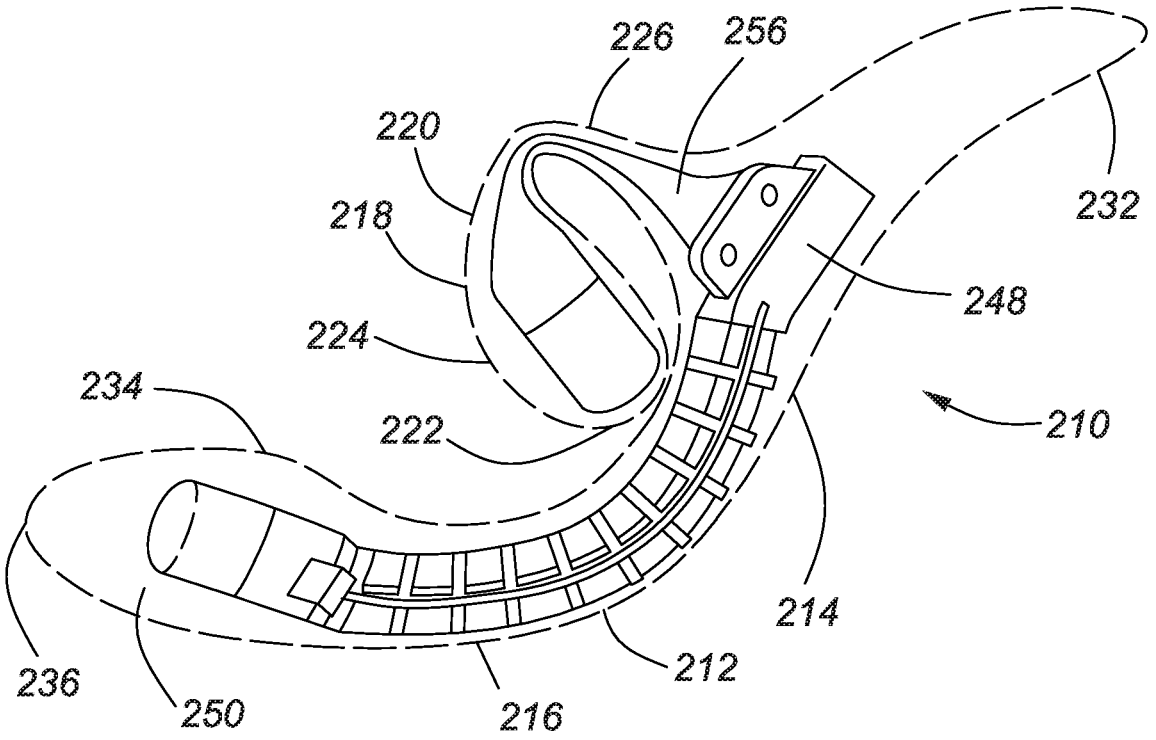

FIGS. 12(*a*)-(*c*) depict another embodiment of the present stimulation device, which is particularly suited to G-spot and clitoral stimulation. Device 210 includes an elongate member 212 comprising a proximal end 214 and a distal end 216, wherein the distal end 216 is dimensioned for placement in a vagina for internal G-spot stimulation. The device further includes an external stimulation arm shown as clitoral stimulation arm 218 comprising a proximal clitoral stimulation arm end 220, a distal clitoral stimulation arm end 222, and an external stimulation surface shown as clitoral stimulation surface or pad 224. The clitoral stimulation arm 218 and elongate member 212 are connected at their respective proximal ends (214, 220) by a flexible connecting portion 226. The flexible connecting portion 226 permits movement of the clitoral stimulation arm 218 relative to the elongate member 212 between: an open position, as exemplified in 12(*a*), wherein the distal clitoral stimulation arm end 222 is spaced apart from the proximal end 214 of the elongate member 212; and a compressed position, as exemplified in FIG. 12(*c*), wherein the distal clitoral stimulation arm end 222 is in close proximity to the proximal end 214 of the elongate member 212. FIG. 12(*b*) illustrates the device 210 in a partially compressed position.

As noted above, when in the open position, the flexible connecting portion 226 together with the clitoral stimulation arm 218 and the elongate member 212 define a gap therebetween. When in the compressed position, the gap defined by the flexible connecting portion 226 together with the clitoral stimulation arm 218 and the elongate member 212 is decreased.

The clitoral stimulation arm 218 is configured for contact with a woman's clitoris and/or the surrounding clitoral area, in order to provide clitoral stimulation during use. The clitoral stimulation arm 218 comprises an inner face 228 that faces the proximal end 214 of the elongate member 212 when the device is in the open position, and an outer face 230 opposite from the inner face 228, and the clitoral stimulation surface 224 extends along at least a portion of the outer face 230 of the clitoral stimulation arm 218. The clitoral stimulation surface 224 is designed to be in at least partial contact with a woman's clitoral area during use, and in particular embodiments in at least partial contact with the clitoris during use. The flexible connecting portion 226 facilitates the constant, or substantially constant, contact between clitoral stimulation surface 224 and the woman's clitoral area during use, because of the range of motion afforded by the flexible connection. The clitoral stimulation surface 224 can be smooth, or can have raised bumps, raised waves, raised concentric circles, nubbies, or any other texture desired.

As shown in FIGS. 12(*a*)-(*c*), the clitoral stimulation arm 218 can have a curved shape. In the embodiment shown in FIGS. 12(*a*)-(*c*), the inner face 228 and the outer face 230 are both convex.

The device 210 further includes a handle 232 disposed on the proximal end 214 of the elongate member 212, which allows the user to hold the device in place and manually move the distal end 216 of the elongate member 212 in and out of, and within, the vagina. The handle 232 can be integrally formed with the elongate member 212, or it can be a separate attachment as discussed further below. Optionally, the grip or gripping region of the handle 232 includes ridges or other ergonomically shaped indentations for easy gripping during use. In the embodiment shown in FIGS. 12(*a*)-(*c*), the handle 232 extends outwardly from the proximal end 214 of the elongate member 212 such that the handle 232 and the elongate member 212 form a generally sigmoidal shape in side view.

As described above, the distal end 216 of the elongate member 212 is dimensioned for insertion in the vagina and includes a region that is specifically designed for stimulation of the G-spot. In this embodiment, the distal end 216 of the elongate member 212 includes G-spot stimulation region 234 that is an inwardly curved flared portion. However, the G-spot stimulation region 234 can include various shapes, such as, for example, an inwardly curved hook or bend or a bulbous head. As shown in FIGS. 12(*a*)-(*c*), the distal end 216 of the elongate member 212 terminates in a rounded tip 236. As with the clitoral stimulation surface 224, the outer surfaces of the elongate member 212 can be smooth, or can be textured in whole or in part.

The fact that the elongate member 212 generally tapers down in width and thickness from its widest, thickest portion at G-spot stimulation region 234 towards the middle portion 238 of the elongate member 212 permits a broad range of motion of the device during use, since the narrowed middle portion 238 of the elongate member 212 is sufficiently narrow to permit movement within the entrance to the vagina. This allows for greater maneuverability of the device and can also account for the above-noted variations in genital anatomy.

The device 210 comprises an internal skeleton 248 formed from, for example, molded plastic, a thermoplastic polymer, a resilient plastic, and/or pre-shaped metal, having the same properties as noted above in respect of device 10 and device 110. As noted above, in another embodiment, the internal skeleton can be formed from a shape memory alloy, a thermoplastic polymer, or combinations thereof. In another embodiment, the internal skeleton can be formed from resilient materials, malleable materials, and combinations thereof.

As can be seen in FIGS. 12(*a*)-(*c*), the internal skeleton 248 disposed within the flexible connecting portion 226 has a much simpler configuration than the embodiments noted above and includes a single arm 256 which is tapered toward the middle portion of the flexible connecting portion. The single arm 256 functions as a spring hinge and provides the spring force to make the connecting portion resiliently flexible. This particular embodiment has the benefit of fewer moving parts relative to embodiments described above, and is expected to have a longer life as a result. In this embodiment, the motion of the clitoral stimulation arm 218 is more radial than linear; however, this embodiment still maintains constant, or substantially constant, contact between clitoral stimulation surface 224 and the woman's clitoral area during use.

As noted above, when a force is applied to the clitoral stimulation surface 224 of the clitoral stimulation arm 218, this effects movement of the clitoral stimulation arm 218 relative to the elongate member 212 towards the compressed position. When the force applied to the clitoral stimulation surface 224 of the clitoral stimulation arm 218 is decreased or removed, the device returns to the open position. In the absence of an applied force, the device remains in the open (resting) position. The flexible connecting portion 226 can be either resilient or malleable, and as noted above preferably at least a portion of the connecting portion is resilient such that the connecting portion is resiliently flexible. The flexible connecting portion 226 can maintain the distal clitoral stimulation arm end 222 resiliently spaced apart from the proximal end 214 of the elongate member 212 in the open position and/or resiliently urge the distal clitoral stimulation arm end 222 away from the proximal end 214 of the elongate member 212 when the clitoral stimulation arm 218 is moved toward the compressed position.

The other aspects of device 210 are otherwise as set out above in respect of device 10 with respect to internal components, outer layer (denoted as 250 in FIGS. 12(*a*)-(*c*)), dimensions, mode of use, etc.

Figure 13:
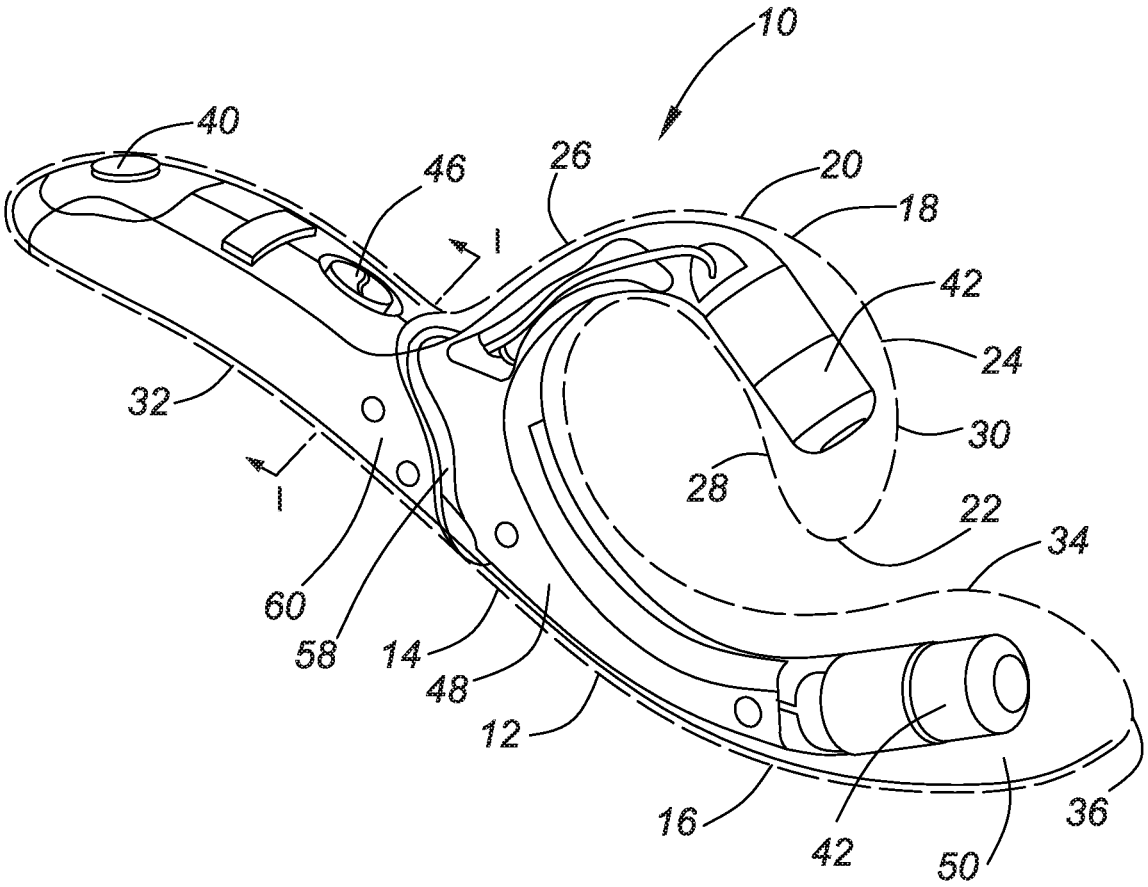
FIG. 13 is a perspective view of the stimulation device shown in FIG. 1, in an open position, having a transparent outer layer, and a semi-transparent internal skeleton, in order to show the internal components, in particular the vibration isolating silicone layer between the handle housing and internal skeleton.
Figure 14:
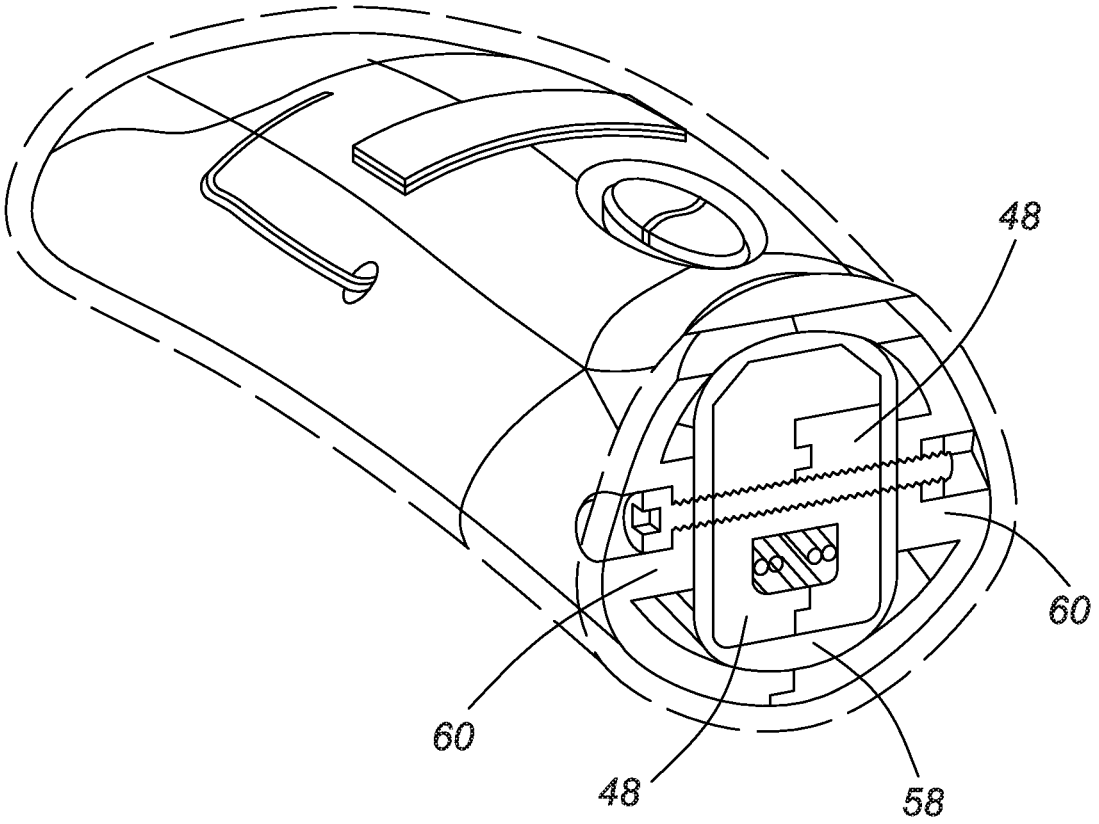
FIG. 14 is a cross-sectional view along line 1-1 of FIG. 13.

As noted above, the stimulation device described herein can include one or more vibrational sources located within the elongate member, the flexible connecting portion, and/or the clitoral stimulation arm. It is particularly desirable to isolate the vibrations from the vibrational sources to those portions of the device, and minimize the amount of vibration that is transferred to the handle which is gripped by the user. FIG. 13 is a perspective view of the embodiment of the stimulation device shown in FIGS. 1-7, 8(*a*)-(*c*) and 9(*a*)-(*c*), in an open position, having a transparent outer layer, and a semi-transparent internal skeleton, in order to show the internal components, in particular the vibration isolating layer 58 between the handle housing 60 and internal skeleton 48. FIG. 14 is a cross-sectional view along line 1-1 of FIG. 13. As can be seen from FIGS. 13 and 14, the handle housing 60 is substantially vibrationally isolated from the internal skeleton 48 as it "floats" on vibration isolating layer 58. Vibration isolating layer 58 can comprise silicone or another compressibly resistive material such as rubber, elastomer (e.g. thermoplastic elastomer/rubber (TPE/TPR)), latex, or other dampening material. In one embodiment, the vibration isolating layer 58 is a layer of silicone.

Similar means for vibrationally isolating the handle can be incorporated into embodiments of the device shown in FIGS. 10(*a*)-(*c*), 12(*a*)-(*c*), as well as alternate embodiments of the device.

Additional Features and Components

The present stimulation device and its parts can be made of any compliant, non-toxic material, such as, for example, those materials set forth in Applicant's U.S. Patent Application Publication No. 2008/0009775, published Jan. 10, 2008, the entire contents of which are incorporated by reference herein. The outer surfaces of the device can be made of materials such as elastomer, silicone, vinyl, rubber (e.g., a urethane rubber), plastic, among others, or combinations thereof. Preferably, the device has an outer layer of medical grade silicone covering the entirety of the device, including the handle. Optionally, the outer surfaces of each part of the device are as smooth as possible, to ensure a pleasurable experience by the user. The device can be any colour or combination of colours, can be clear or opaque, or a combination, and can include designs and/or logos thereon.

As noted above, the device can include electrical materials or components inside the outer surfaces, including wires, batteries and motor(s) or other stimulation sources (vibrational source(s) and/or sources of movement, sources of electrostimulation). In the embodiments in which the device comprises at least one stimulation source, the present stimulation device includes a power means or source. The power source is a storage medium for, and subsequently, a source of, direct current (DC) power. In one embodiment, the power source is operatively connected to a controller, described in further detail below. A non-limiting example of such a power means or source is a battery, for example, one or more rechargeable batteries housed within the device, or one or more disposable batteries. The power source may include, but is not limited to, one or more nickel cadmium, nickel metal hydride, lithium ion, or any other type of power cell(s). In some embodiments, a rechargeable battery is located in the handle, and the stimulation device includes an outlet for recharging the battery. In other embodiments, the rechargeable battery in the device can be charged wirelessly, such as via magnetic resonance charging.

In addition, in the embodiment in which the device comprises at least one stimulation source (vibration source, source of movement, source of electrostimulation) the device also comprises a switch mechanism to turn the stimulation source(s) on and off, and to also control the type and strength/intensity of vibration/movement of the device during use.

As noted above, the stimulation device of the present application optionally includes one or more stimulation sources (such as vibrational sources and/or one or more sources of movement, or sources of electrostimulation) for increased stimulation during use. For example, one or more of such sources of stimulation can be disposed in any of the external stimulation arm, the flexible connecting portion, the elongate member, or a combination thereof. In some embodiments, a vibrational source(s) is disposed in only in the external stimulation arm, and in other embodiments, vibrational sources are disposed in both the elongate member and in the external stimulation arm.

The electronic components of the device can be located within the internal skeleton of the device, which is covered by the outer layer of non-toxic material, as described above. The outer components of the device should be free of defects, holes, or other openings, so as to effectively protect the electronic components housed therein and, optionally, to ensure the device is waterproof or water resistant.

Although the surfaces of the device of the present application can be smooth, in some embodiments, the device includes one or more textured surfaces. For example, the external stimulation surface of the external stimulation arm can be textured, such as having raised bumps, raised waves, raised concentric circles, nubbies, or any other texture desired. Similarly, the surface of the elongate member can also be textured, in whole or in part. In one embodiment, the elongate member is dimensioned for insertion in a vagina and has a G-spot contacting surface which is textured. Alternatively, the surface of the elongate member can be smooth.

Further, any portion of the handle, external stimulation arm, flexible connecting portion, or elongate member of device of the present application can be resilient or malleable. It is not necessary for the entire device to be either resilient or malleable; rather, in some examples, only a certain part, or parts, of the device are resilient or malleable. For example, the elongate member can be malleable while the flexible connecting portion is resilient, or the handle can be malleable (which can allow the handle to be adapted for user preferences). Any combination of resilient portions and malleable portions can be employed, depending upon the desired use and feel. Preferably, at least a portion of the flexible connecting portion is resilient, as noted above.

As noted above, the device can include an internal skeleton formed from, for example, molded plastic, a thermoplastic polymer, a resilient plastic, and/or pre-shaped metal (such as shape memory alloys (e.g. TiNi or the like), malleable metals, or resilient metals) so that a portion of the body as well as the outer layer can be made from a very soft material, such as a soft silicone, most preferably a medical-grade silicone. As noted above, in another embodiment, the internal skeleton can be formed from a shape memory alloy, a thermoplastic polymer, or combinations thereof. In another embodiment, the internal skeleton can be formed from resilient materials, malleable materials, and combinations thereof. The internal skeleton can extend from the external stimulation arm, through the flexible connecting portion, to the elongate member. A metal skeleton can be useful in providing a malleable device which can retain its shape after the application of force thereon (the use of malleable materials allows a user to bend the device strategically so that it is the precise shape they want; normal use does not flex the device enough to cause it to appreciably take on a new shape (i.e. it keeps its shape after adjusting)). In some embodiments, the use of shape memory alloys can be useful in providing a resilient device, which springs back to its original shape after the application of force is removed. Further, the internal skeleton can be comprised of a combination of resilient and malleable materials. Examples of useful metals include, but are not limited to, nitino and, stainless steel. Polymers useful in the internal skeleton include, without limitation, polypropylene, polyethylene, polymethacrylics, and combinations thereof. Combinations of polymeric and metallic internal skeletons are also useful. Further, in one embodiment, the external stimulation arm and/or elongate member can contain one or more friction fittings/joints as part of the internal skeleton to allow the user to further customize the shape of the device.

As noted above, the stimulation device of the present application can include one or more stimulations sources, for example a vibrational source, such as a vibrational motor, or a capacitive or dielectric based actuator. The device can also include one or more sources of movement. In other embodiments, the device can contain other sources of stimulation, such as electrostimulation. In these embodiments, the device further comprises an internal or external power source that provides power to such stimulation sources. In one example, the stimulation source can be at least one independently operating vibrational source. In one example, a vibrational source or sources, if multiple sources are used, can be operated to create a harmonic vibration in the device. It can be especially preferable to use vibrational sources that provide a harmonic pulsation in at least one component of the device, due to various interactions between the vibrations produced by sources within the device.

It may be desired that one or more vibrational motor is disposed in the elongate member, and another one or more motor is disposed in the external stimulation arm. The locations of the motors can be varied within the elongate member, the external stimulation arm and/or the flexible connecting portion.

Any desired vibrational source and/or source of movement can be used in the present stimulation device. In certain embodiments, the vibrational source is a longitudinally oriented vibration motor provided with a small rotating eccentric weight or a piezo buzzer. Desirably, the motor is capable of reaching vibrational frequencies of between about 240 and about 10,000 RPM. Such a motor can be provided in a removable component, for example, a bullet vibrator as is commonly used in the field. Alternatively, the motor(s) is permanently or otherwise removably included in the device.

In some embodiments, the motor(s) or other sources of movement is capable of providing the device, or a component thereof, with motion, such as linear or circular motion, during use. Such movement can be controlled by a controller, such as a microprocessor, and can perform varied patterns and rhythms, for example, in a range of from about 6 to about 600 Hz with an amplitude up to about 0.2". Springs, pistons, and/or other materials can be used to achieve the desired vibration and/or motion. The vibration can also be achieved using a vibrating cylindrical or disk-shaped motor, that optionally includes electro-stimulation pad(s). Mechanical movement can be achieved through the use of drive shafts or push/pull rods housed in any component of the device. For instance, the external stimulation arm can be powered mechanically to move left and right and/or up and down and/or rotate, to apply more or less pressure in a rhythmic pattern to provide varying pressure, and such mechanical movement can be coupled with vibratory stimulation. In another embodiment, the inner arm can move with a "come hither" motion, or move from side-to-side, or twist while the device is in use.

The vibration source(s) can be protected in a protective shell. In one example, more than one longitudinally oriented vibration motor can be provided and, in such instances, wiring within the internal skeleton of the device can connect the first motor to a second motor, and then further wiring connects two motors to a power source. Such vibration motors can be connected to the power source in series or in parallel, or a combination thereof when there are more than two motors.

It will be understood, moreover, that the number, orientation, and strength of the vibrational source(s) and/or sources of movement, will be a matter of choice to one skilled in the art.

The switch mechanism, which is optionally a push button and controller/central processing unit, or alternatively includes a variable-position sliding switch, can be located near an end of the handle of the sexual stimulation device so that it can be manipulated between an "off" position and at least one "on" position before, during and/or after use. In some embodiments, the device can also be controlled by wireless means, such as radiofrequency, bluetooth or other wireless methods. In such instances, the stimulation device can be provided with a remote control or, alternatively, it can be controlled using a secondary device (e.g., a mobile bluetooth enabled device). In a preferred embodiment, the device can be controlled by a switch mechanism located near an outer end of the handle of the stimulation device and also by a switch mechanism that functions wirelessly in a remote control.

Furthermore, the switch mechanism can be provided with any number of "on" settings to power any combination of vibrational source and/or source of movement. For example, the switch mechanism can power any combination of the motors at the same or different levels or direction of rotation or other movement. In addition to increasing or reducing the strength of the vibrations, this can create variable harmonic wave patterns in the device, so that a harmonic wave pattern pleasing to the user can be selected on an individual user basis. Moreover, the switch mechanism can be a push button, a dial, or any other suitable type of switch. Furthermore, the outer shell of the device itself can be made from a bimetallic alloy capable of "twitching" upon application of a current, which may be applied in any desired pattern.

The stimulation device can include a controller operatively connected to the one or more stimulation sources (such as vibrational sources and/or one or more sources of movement, or sources of electrostimulation), and one or more power source(s), such as a battery. The controller may be a computer processor, and/or one or more integrated circuits for processing instructions. For example, the controller may be one or more cores, or micro-cores of a processor. Additionally, or alternatively, processing in the stimulation device may be performed using an application specific integrated circuit (ASIC), a discrete processor, a field programmable gate array (FPGA), a digital signal processor (DSP), a microcontroller, or any other type of integrated circuit or combination thereof. Moreover, the controller may process software and/or firmware instructions, in the form of computer readable program code, to perform embodiments of the invention. The instructions may be related to, for example, the managing of the power source(s), the monitoring and operating of the one or more stimulation sources, the aggregation of sensor information from optionally included sensors in the stimulation device, and the bidirectional communication of sensor information, instructions, etc., with other networked computing systems and/or devices. In one embodiment of the invention, the software and/or firmware instructions may be stored, in whole or in part, temporarily or permanently, on a non-transitory computer readable medium (not shown) such as a storage device, flash memory, physical memory, or any other computer readable storage medium. Specifically, the aforementioned instructions may correspond to computer readable program code that, when executed by the controller, is configured to perform embodiments of the invention.

In one embodiment of the invention, the controller includes functionality to monitor and/or operate the one or more stimulation sources. In one embodiment, the controller includes functionality to actuate one or more vibrational source(s). In one embodiment of the invention, towards generating varying effects towards enhancing the stimulation and/or arousal of a user, the controller may actuate a vibrational source separately or more than one vibrational sources concurrently. Characteristics of the vibrational source(s) that the controller may manipulate in generating desired effects include, but are not limited to, the frequency (or speed) of the vibrations, the intensity (or amplitude) of the vibrations, the phase (or offsetting) of vibrations induced by the vibrational source(s), the direction of rotation of the actuated movement, etc. These varying effects are discussed in further detail above with respect to harmonic vibration/pulsation.

In one embodiment of the invention, the stimulation device may include one or more sensor(s) operatively connected to any one or more components of the stimulation device. The sensor(s) refer to hardware, software, firmware, or any combination thereof, which detects and measures one or more physical properties (e.g., heat, light, sound, pressure, motion, etc.). The sensor(s) may further include functionality to encode these aforementioned measurements into analog and/or digital signals (or data) that may be interpreted and/or pre-processed by the controller. Examples of the sensor(s) include, but are not limited to, an accelerometer, a global positioning system (GPS) device, a pressure sensor, a temperature sensor, a microphone, a camera, a light detector, a photopletismograph (PPG) (i.e., a blood flow sensor), an electroencephalograph (i.e., a bioelectricity sensor), a photoionization detector (PID) (i.e., a gas and/or organic compound sensor), etc. In one embodiment of the invention, the sensor(s) may serve, separately or in combination, to provide information pertaining to, for example, orientation, biometrics, environmental conditions, and control feedback (e.g., pertinent to the performance of the stimulation device).

In one embodiment, one or more sensors can be located on the elongate member to detect the degree of insertion of the elongate member into the orifice of the user and/or one or more sensors can be located on the external stimulation arm to detect the degree of bending of the external stimulation arm, so that the device can vary stimulation based on, for example, pressure applied to the clitoral area by the external stimulation arm and/or pressure applied to the elongate member via contraction of Kegel muscles and/or the degree of insertion of the elongate member into the orifice of the user when the device is in use.

In another embodiment, information from the one or more sensors can be relayed to other devices, to remote users of other sexual stimulation devices, can be used to collect data for orgasm detection, pressure sensors can be used to provide Kegel exercise feedback results, etc. Additional information around usage of sensor data and the application of same to socialization and gamification can be found in co-pending PCT Application Serial No. PCT/CA2016/050706 entitled, "Sensor Acquisition and Analytics Platform for Enhancing Interaction with Adult Devices", the entire contents of which are incorporated by reference herein.

In accordance with another embodiment, the stimulation device is programmable. That is, the device can be programmed based on a particular user's preferences to provide, for example, a set vibration speed, combination of speeds, variation of vibration or pattern of vibration and/or movement. In certain examples, the device can be programmed to include multiple preset vibration settings/patterns.

The sexual stimulation device optionally includes or is provided with a recharging circuit and outlet. The recharging outlet can be accessible from the outside of the device, but it can be covered with a removable plug or sheath of non-toxic material in order to ensure that the device is water resistant or waterproof. Alternately, the recharging circuit is an induction recharger or magnetic resonance charger that does not require metal-to-metal contact.

In one embodiment, the device comprises a recharging means, e.g., a rechargeable battery, that provides a trickle charge and/or quick charge.

In accordance with another embodiment, the stimulation device is provided with a storage case or bag, which can be used for storage and/or travel.

It will also be understood that the present sexual stimulation device can be manufactured with a non-rechargeable battery, and so not be provided with a recharging circuit and outlet. If desired, the unit can be considered disposable after the battery is completely discharged. Alternatively, replaceable batteries can be used. In this case, the device is provided with a re-sealable access means, such as a peel-back silicone layer, to access the batteries, while providing protection and, optionally, water resistance during use.

Particular embodiments have been described above with respect to a combination internal and external stimulation device having an elongate member comprising a proximal end and a distal end dimensioned for placement in an orifice of a user, wherein the elongate member is connected to an external stimulation arm by way of a flexible connecting portion as described above. However, those of skill in the art will appreciate that the unique features of the flexible connecting portion and the external stimulation arm could be incorporated into another device, such as a cock ring, saddle, or cock sleeve having the external stimulation arm mounted at the base thereof, wherein a penis could provide internal stimulation in place of the elongate member.

All publications, patents and patent applications mentioned in this Specification are indicative of the level of skill of those skilled in the art to which this invention pertains and are herein incorporated by reference to the same extent as if each individual publication, patent, or patent application was specifically and individually indicated to be incorporated by reference.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The embodiments of the invention in which an exclusive property or privilege is claimed are defined as follows:

1. A sexual stimulation device comprising:

(a) an elongate member comprising a proximal end and a distal end, wherein the distal end is dimensioned for placement in an orifice of a user;

(b) an external stimulation arm comprising a proximal external stimulation arm end, a distal external stimulation arm end, and an external stimulation surface for stimulating an external surface of the user when the distal end of the elongate member is placed in the orifice;

(c) a flexible connecting portion that connects the elongate member to the external stimulation arm at their respective proximal ends; and (d) a handle, wherein the handle extends outwardly from the proximal end of the elongate member such that the handle and the elongate member form a generally sigmoidal shape in side view;

wherein the flexible connecting portion permits movement of the external stimulation arm relative to the elongate member between:

an open position, wherein the distal external stimulation arm end is spaced apart from the proximal end of the elongate member; and a compressed position, wherein the distal external stimulation arm end is in close proximity to the proximal end of the elongate member;

wherein the external stimulation arm comprises an inner face facing the proximal end of the elongate member in the open position, and an outer face opposite from the inner face, and the external stimulation surface extends along at least a portion of the outer face of the external stimulation arm; and wherein the flexible connecting portion is configured to provide constant contact between the external stimulation surface of the external stimulation arm and the external surface of the user while the distal end of the elongate member moves in and out and within the orifice of the user.

2. The device of claim 1, wherein when the device is in the open position, the flexible connecting portion together with the external stimulation arm and the elongate member define a gap therebetween and when the device is in the compressed position, the gap is decreased.

3. The device of claim 1, wherein the device further comprises one or more of the following characteristics:

when the device is in the open position, the flexible connecting portion together with the proximal external stimulation arm end and the proximal end of the elongate member defines a general U-shape or C-shape;

the flexible connecting portion is resilient, malleable, or a combination thereof;

at least a portion of the flexible connecting portion is resilient; and the flexible connecting portion maintains the distal external stimulation arm end resiliently spaced apart from the proximal end of the elongate member in the open position and/or wherein the flexible connecting portion resiliently urges the distal external stimulation arm end away from the proximal end of the elongate member when the external stimulation arm is moved toward the compressed position.

4. The device of claim 1, wherein the orifice is a vagina and the external surface of the user is a clitoral area, or the orifice is an anus and the external surface of the user is a perineum region of the user.

5. The device of claim 1, further comprising one or more of:

an internal skeleton; and an outer layer of non-toxic material.

6. The device of claim 5, wherein:

the internal skeleton is formed from molded plastic, a thermoplastic polymer, a resilient plastic, and/or pre-shaped metal, and extends at least from the external stimulation arm, through the flexible connecting portion, to the elongate member.

7. The device of claim 6, wherein the internal skeleton comprises a first arm and a second arm disposed within the flexible connecting portion, wherein:

the first arm is hingedly connected to a first portion of the internal skeleton located at or near the proximal end of the elongate member, at a first hinge point, forming a first hinge;

the first arm is hingedly connected to a second portion of the internal skeleton located at or near the proximal external stimulation arm end of the external stimulation arm, at a second hinge point, forming a second hinge;

the second arm is hingedly connected to a third portion of the internal skeleton located at or near the proximal end of the elongate member, at a third hinge point, forming a third hinge; and the second arm is hingedly connected to a fourth portion of the internal skeleton located at or near the proximal external stimulation arm end of the external stimulation arm at a fourth hinge point, forming a fourth hinge;

wherein, in side view, the first, second, third, and fourth hinge points together define a quadrangular shape, a generally trapezoidal shape, or a generally parallelogram shape.

8. The device of claim 7, wherein each of the first, second, third, and fourth hinges are independently selected from a living hinge, a spring-type hinge, a pivot, or a combination thereof; and wherein the internal skeleton further comprises at least one spring coupled to the first arm and/or the second arm to maintain the device in the open position, wherein the spring is selected from a compression or tension spring, a silicone spring, a torsion spring, or a leaf spring.

9. The device of claim 6, wherein the internal skeleton comprises a single arm disposed within the flexible connecting portion, wherein the single arm is tapered towards a middle section of the flexible connecting portion.

10. The device of claim 5, wherein the handle comprises a housing formed from molded plastic, a thermoplastic polymer, a resilient plastic, and/or pre-shaped metal, and the housing is substantially vibrationally isolated from the internal skeleton.

11. The device of claim 10, wherein the housing is substantially vibrationally isolated from the internal skeleton by a layer of a compressively resistive material disposed between the housing and the internal skeleton, wherein the compressively resistive material is selected from silicone, rubber, elastomer, or latex.

12. The device of claim 5, wherein the non-toxic material is silicone.

13. The device of claim 1, further comprising at least one stimulation source selected from at least one vibrational source, at least one source of movement, or a source of electrostimulation, wherein the at least one stimulation source is disposed in the external stimulation arm, the flexible connecting portion, the elongate member, or a combination thereof.

14. The device of claim 13, wherein the device comprises at least one of the following characteristics:

the at least one vibrational source is a vibrational motor; and the device further comprises a power source.

15. The device of claim 14, further comprising one or more of the following characteristics:

the power source is at least one battery; and the device further comprises a switch mechanism to turn the at least one stimulation source on and off; wherein the switch mechanism has a plurality of settings to control the type and strength of vibration of the at least one vibrational source and/or the type and strength of movement of the at least one source of movement during use of the device; wherein the at least one vibrational source and/or at least one source of movement is a plurality of motors, and the plurality of settings can power any combination of the motors at the same or different levels or direction of rotation or other movement.

16. The device of claim 15, wherein the switch mechanism is located on the handle.

17. A sexual stimulation device comprising:

(a) an elongate member comprising a proximal end and a distal end, wherein the distal end is dimensioned for placement in an orifice of a user;

(b) an external stimulation arm comprising a proximal external stimulation arm end, a distal external stimulation arm end, and an external stimulation surface for stimulating an external surface of the user when the distal end of the elongate member is placed in the orifice;

(c) a flexible connecting portion that connects the elongate member to the external stimulation arm at their respective proximal ends; and (d) a handle, wherein the handle extends outwardly from the proximal end of the elongate member such that the handle and the elongate member form a generally sigmoidal shape in side view;

wherein the flexible connecting portion permits movement of the external stimulation arm relative to the elongate member between:

an open position, wherein the flexible connecting portion together with the external stimulation arm and the proximal end of the elongate member define a gap therebetween; and a compressed position, wherein the gap is decreased;

wherein the external stimulation arm comprises an inner face bordering the gap and an outer face opposite from the inner face, and the external stimulation surface extends along at least a portion of the outer face of the external stimulation arm; and wherein the flexible connecting portion is configured to provide constant contact between the external stimulation surface of the external stimulation arm and the external surface of the user while the distal end of the elongate member moves in and out and within the orifice of the user.

18. The device of claim 17, wherein the device further comprises one or more of the following characteristics:

when the device is in the open position, the flexible connecting portion together with the proximal external stimulation arm end and the proximal end of the elongate member defines a general U-shape or C-shape;

the device further comprises a handle, wherein the handle extends outwardly from the proximal end of the elongate member such that the handle and the elongate member form a generally sigmoidal shape in side view;

the flexible connecting portion is resilient, malleable, or a combination thereof;

at least a portion of the flexible connecting portion is resilient; and the flexible connecting portion maintains the distal external stimulation arm end resiliently spaced apart from the proximal end of the elongate member in the open position and/or wherein the flexible connecting portion resiliently urges the distal external stimulation arm end away from the proximal end of the elongate member when the external stimulation arm is moved toward the compressed position.

19. The device of claim 17, wherein the orifice is a vagina and the external surface of the user is a clitoral area, or the orifice is an anus and the external surface of the user is a perineum region of the user.

20. The device of claim 17, further comprising one or more of:

an internal skeleton; and an outer layer of non-toxic material.

21. The device of claim 20, wherein:

the internal skeleton is formed from molded plastic, a thermoplastic polymer, a resilient plastic, and/or preshaped metal, and extends at least from the external stimulation arm, through the flexible connecting portion, to the elongate member.

22. The device of claim 21, wherein the internal skeleton comprises a first arm and a second arm disposed within the flexible connecting portion, wherein:

the first arm is hingedly connected to a first portion of the internal skeleton located at or near the proximal end of the elongate member, at a first hinge point, forming a first hinge;

the first arm is hingedly connected to a second portion of the internal skeleton located at or near the proximal external stimulation arm end of the external stimulation arm, at a second hinge point, forming a second hinge;

the second arm is hingedly connected to a third portion of the internal skeleton located at or near the proximal end of the elongate member, at a third hinge point, forming a third hinge; and the second arm is hingedly connected to a fourth portion of the internal skeleton located at or near the proximal external stimulation arm end of the external stimulation arm at a fourth hinge point, forming a fourth hinge;

wherein, in side view, the first, second, third, and fourth hinge points together define a quadrangular shape, a generally trapezoidal shape, or a generally parallelogram shape.

23. The device of claim 22, wherein each of the first, second, third, and fourth hinges are independently selected from a living hinge, a spring-type hinge, a pivot, or a combination thereof; and wherein the internal skeleton further comprises at least one spring coupled to the first arm and/or the second arm to maintain the device in the open position, wherein the spring is selected from a compression or tension spring, a silicone spring, a torsion spring, or a leaf spring.

24. The device of claim 21, wherein the internal skeleton comprises a single arm disposed within the flexible connecting portion, wherein the single arm is tapered towards a middle section of the flexible connecting portion.

25. The device of claim 20, wherein the handle comprises a housing formed from molded plastic, a thermoplastic polymer, a resilient plastic, and/or pre-shaped metal, and the housing is substantially vibrationally isolated from the internal skeleton.

26. The device of claim 25, wherein the housing is substantially vibrationally isolated from the internal skeleton by a layer of a compressively resistive material disposed between the housing and the internal skeleton, wherein the compressively resistive material is selected from silicone, rubber, elastomer, or latex.

27. The device of claim 20, wherein the non-toxic material is silicone.

28. The device of claim 17, further comprising at least one stimulation source selected from at least one vibrational source, at least one source of movement, or a source of electrostimulation, wherein the at least one stimulation source is disposed in the external stimulation arm, the flexible connecting portion, the elongate member, or a combination thereof.

29. The device of claim 28, wherein the device comprises at least one of the following characteristics:

the at least one vibrational source is a vibrational motor; and the device further comprises a power source.

30. The device of claim 29, further comprising one or more of the following characteristics:

the power source is at least one rechargeable battery; and the device further comprises a switch mechanism to turn the at least one stimulation source on and off; wherein the switch mechanism has a plurality of settings to control the type and strength of vibration of the at least one vibrational source and/or the type and strength of movement of the at least one source of movement during use of the device; wherein the at least one vibrational source and/or at least one source of movement is a plurality of motors, and the plurality of settings can power any combination of the motors at the same or different levels or direction of rotation or other movement.

31. The device of claim 30, wherein the switch mechanism is located on the handle.

* * * * *